US006875076B2

(12) United States Patent
Abrahamians et al.

(10) Patent No.: US 6,875,076 B2
(45) Date of Patent: Apr. 5, 2005

(54) POLISHING MACHINE AND METHOD

(75) Inventors: Edmond Abrahamians, Fremont, CA (US); Igor Kravtsov, Mountain View, CA (US); Herbert Wayne Owens, Jr., San Jose, CA (US); William Jefferson Stone, III, Santa Cruz, CA (US); Vladimir Volovich, Mountain View, CA (US); Yakov Keyfes, San Francisco, CA (US)

(73) Assignee: Accretech USA, Inc., Bloomfield Hills, MI (US)

( * ) Notice: Subject to any disclaimer, the term of this patent is extended or adjusted under 35 U.S.C. 154(b) by 193 days.

(21) Appl. No.: 10/173,878

(22) Filed: Jun. 17, 2002

(65) Prior Publication Data

US 2003/0232574 A1 Dec. 18, 2003

(51) Int. Cl.[7] ..... B24B 49/00
(52) U.S. Cl. ..... 451/5; 451/57; 451/285
(58) Field of Search ..... 451/5, 57, 285, 451/286, 287, 288, 289, 290, 41

(56) References Cited

U.S. PATENT DOCUMENTS

| | | | | |
|---|---|---|---|---|
| 5,140,774 A | | 8/1992 | Onodera | 51/134 |
| 5,197,230 A | | 3/1993 | Simpfendörfer et al. | 51/165.77 |
| 5,205,082 A | | 4/1993 | Shendon et al. | 51/283 |
| 5,527,209 A | | 6/1996 | Volodarsky et al. | 451/388 |
| 5,562,524 A | | 10/1996 | Gill, Jr. | 451/1 |
| 5,616,063 A | | 4/1997 | Okumura et al. | 451/1 |
| 5,618,227 A | | 4/1997 | Tsutsumi et al. | 451/288 |
| 5,679,059 A | | 10/1997 | Nishi et al. | 451/41 |
| 5,695,601 A | | 12/1997 | Kodera et al. | 156/636.1 |
| 5,738,574 A | | 4/1998 | Tolles et al. | 451/288 |
| 5,827,110 A | * | 10/1998 | Yajima et al. | 451/5 |
| 5,830,045 A | * | 11/1998 | Togawa et al. | 451/288 |
| 5,857,899 A | | 1/1999 | Volodarsky et al. | 451/72 |
| 5,885,134 A | | 3/1999 | Shibata et al. | 451/41 |
| 6,024,630 A | | 2/2000 | Shendon et al. | 451/41 |
| 6,050,885 A | | 4/2000 | Mörsch et al. | 451/287 |
| 6,074,277 A | | 6/2000 | Arai | 451/8 |
| 6,113,480 A | | 9/2000 | Hu | 451/289 |
| 6,126,517 A | * | 10/2000 | Tolles et al. | 451/41 |
| 6,142,857 A | | 11/2000 | Cesna | 451/287 |
| 6,210,260 B1 | | 4/2001 | Tanaka et al. | 451/289 |
| 6,213,853 B1 | | 4/2001 | Gonzalez-Martin et al. | 451/287 |
| 6,213,855 B1 | | 4/2001 | Natalicio | 451/364 |
| 6,227,946 B1 | | 5/2001 | Gonzalez-Martin et al. | 451/54 |
| 6,290,578 B1 | | 9/2001 | Bowman et al. | 451/41 |
| 6,296,546 B1 | | 10/2001 | Allen et al. | 451/5 |
| 6,336,853 B1 | | 1/2002 | Schultz et al. | 451/398 |
| 6,350,177 B1 | | 2/2002 | Gonzalez-Martin et al. | 451/41 |
| RE37,622 E | | 4/2002 | Karlsrud et al. | 451/11 |

* cited by examiner

*Primary Examiner*—Lee D. Wilson
*Assistant Examiner*—Alvin J Grant
(74) *Attorney, Agent, or Firm*—Harness, Dickey & Pierce, PLC

(57) ABSTRACT

An apparatus and method is provided for polishing work pieces such as semiconductor wafers. The apparatus includes a variable number of independent heads 20, platens 32 and polishing units 18. This polishing apparatus belongs to a group of polishing machines with wafers attached to the same heads 20 through all polishing steps without undesirable reloading from one head 20 to another between polishing steps. Each independent head 20 is automatically coupled to and decoupled from any of the polishing units 18 to optimize throughput and provide flexibility in accommodating different polishing processes. A head transfer subsystem 22 provides an independent means of transfer for each head 20, thus an infinite number of contemporaneous or overlapping polishing cycles can be completed on multiple wafers resulting in maximum processing throughput.

24 Claims, 21 Drawing Sheets

| |
|---|
| Figure 14D |
| Figure 14C |
| Figure 14B |
| Figure 14A |

POLISHING MACHINE AND METHOD

RELATED APPLICATIONS

This application is also related to the following commonly assigned applications entitled:

(1) Wafer Polishing Machine", Ser. No. 09/993,863; and (2) "Machine and System for Polishing Wafers", Ser. No. 10/007,260.

TECHNICAL FIELD

The present invention relates to a method and system for polishing relatively thin work pieces, for example, wafers used in the manufacture of semiconductors. More particularly, the present invention teaches a revolutionary improvement in the field, whereby use of independently mobile heads circulating inside of the machine and a head transfer robot (HTR) subsystem maximize processing throughput and eliminate the undesirable intraprocess step of loading and unloading of the fragile wafers.

BACKGROUND ART

The semiconductor industry produces vast quantities of semiconductor wafers; i.e., thin slices of a semiconductive material used as a base for an electronic component or integrated circuit. Each wafer typically includes a flat, highly-polished surface critical for formation of the integrated circuit, and, by extension, performance of the semiconductor. Therefore, the geometry and quality of the wafer surface are absolute prerequisites to product performance in this field of endeavor. To achieve optimal surface conditions for circuit formation, wafers are polished. Generally, this is accomplished with a polishing machine, models of which are known in the art.

For example, many models of the prior and current art provide machines having one or more polishing units with heads that accommodate wafers. Wafer loading mechanisms (WLM) load and unload a wafer into and from the head portion of the polishing unit during various processing steps of a single processing cycle. Once the head of the polishing unit is loaded with a wafer, the polishing unit translates along or around a column until positioned over a rotating platen. The polishing unit vertically descends towards the platen and load forces act to hold a surface of the wafer sovereign to the platen. Thereafter, the machinery components act in concert to polish the wafer surface, producing an end product. There are many polishing machines in the industry that frequently load and unload wafers between polishing processes in multistep polishing. An example of this type of machine is disclosed in the U.S. Pat. No. 5,830,045 to Togawa, et al. which discloses a polishing apparatus that polishes a workpiece such as a semiconductor wafer to a flat mirror finish.

There is second group of machines that avoid undesirable multiple loading and unloading of the fragile wafers. These machines are generally perceived in the industry to be more reliable in operation. An example of this type of machine is disclosed in the U.S. Pat. No. 6,050,885 to Morsch, et al., which discloses a device for the chemical-mechanical polishing of the surface of an object, in particular of the semiconductor wafers for the manufacture of semiconductors, with two polishing units with height-adjustable vacuum holders each for a semiconductor wafer. This machine design is linear in configuration, compact, reliable, easy access for service; however, this linear design has the disadvantage of low throughput.

Successive, linear processing sequences are gated by predecessor sequences, due to the constraint of processing along a single axis, and result in less than optimal throughput. Even in systems having more than one linear processing path (e.g., two platens, two linear guides above the centers of the platens and with two polishing units on different sides of linear guides moving independently in linear fashion on each of two predetermined parallel paths), the number of paths is mechanically limited to just a two, and the number of independent polishing units on each side of the guide assembly is restricted to just one. Each process on each path remains limited by predecessor processes. Thus attempts to increase throughput for this linear design have not been entirely successful (see FIG. 1, with linear path depicted at 2). Another example of this type of machine with single load and unload operation for wafer in multistep processing is the U.S. Pat. No. 5,738,574 to Tolles, et al. (refer to FIGS. 2 and 3; a circular processing path is depicted in FIG. 3 at 4). This machine has high throughput because there are generally three polishing units doing polishing on three platens of the machine. But this machine is less compact and more difficult for service than machine of the previous example and less flexible in formulating polishing processes than polishing machines of the first type.

While it is known in the art that a wafer tends to remain intact if it is securely positioned in the head of the polishing unit, the head of the polishing unit is able to provide protection for the wafer only during the time in which the wafer is actually secured in the head. Further, the systems of the prior art are entirely reliant on a mechanical symbiosis between the head and the polishing unit. This unity of structure is required in the prior art due to the complex network of conduits, valves, chambers and gauges constructed to integrally span both the polishing unit and its head. Thus the prior art head can only be removed from its associated polishing unit on an exceptional basis; e.g., emergency maintenance. Such removal is a time-consuming, labor-intensive manual process that halts normal polishing operations until such maintenance can be completed. Additionally, the interdependency between the prior art polishing unit and its head restrict the throughput, as the head is dependent on its associated polishing unit, and the path of the polishing unit is gated by predecessor polishing units, load and unload processes and the like (refer to FIG. 4, where a polish unit 6 of the prior art and having an integral head 8 and a complex network of conduits 9 integrally distributed throughout the entire polish unit 6 and its integral head 8 is shown).

Examples of such art include the U.S. Pat. No. 6,113,480 to Hu, et al. that discloses a semi-conductor wafer polishing head that includes, inter alia, three air lines, an air control system, including air line pressure checking and chamber leak rate testing, valves, and a pair of air gauges. The U.S. Pat. No. 5,587,899 to Volodarsky, et al. discloses a polishing head for polishing a semiconductor wafer that includes a source of pressurized fluid, vacuum source, valve, adjustable pressure regulator, a first fluid conduit and a second fluid conduit. The U.S. Pat. Nos. 6,024,630 to Shendon, et al., 5,527,209 to Volodarsky, et al., 6,210,260 B1 to Tanaka et al., 5,205,082 to Shendon, et al., and 5,738,574 to Tolles, et al. all disclose similar inventions.

What is needed, then, is an efficient, low-cost apparatus and method for polishing wafers that enable multiple, contemporaneous yet diverse processes cycles, accommodate variable configurations of platens, polishing units, and heads for high throughput. Additionally, such a system and method must provide protection for wafers during all phases of processing to conserve work material and promote efficient processing. It is also desirable to provide the same in a compact construct compatible with various work environments, customer budgets and customer processing needs.

DISCLOSURE OF SUMMARY

The aforementioned issues are resolved with the dynamic system and method of the present invention designed around a concept of independent, freely moving heads for accommodating wafers. The independent, relocatable heads of the present invention removably adjoin with coupling/decoupling means that are controlled from a machine control unit and allow the polishing heads to be coupled and decoupled from one polishing unit to another, thus enabling innumerable, simultaneous processes along a number of similar or diverse paths.

The coupling and decoupling means are located between polishing unit and polishing head in place of the "neck" of the head, thus the heads are independent of the internal polishing head and polishing unit designs, thus various polishing unit designs can accommodate different head designs. A head transfer robot (HTR) subsystem transfers the heads (with or without wafers) to and from any location pertinent to a processing step in a process cycle; e.g., to various polishing units, cleaning stations, etc. Therefore, use of all components can be maximized to carry out multiple, dynamic, contemporaneous processing cycles without intersection interference or queuing inefficiencies, thus providing maximum throughput.

The independent head accommodates the same wafer throughout the entire processing cycle, thus virtually eliminating wafer breakage and time and material waste. The independent head design permits multiple hardware configurations on a single, compact system without the aforementioned encumbrances of the prior art machines. Individual paths for each process cycles wherein a wafer can remain in the head as it completes every step of a processing cycle without interruption can be predefined for each head, thus resolving the issues associated with linear, circular and other fixed-scheme processing technologies. Further, the systems and method accommodate polishing operations of varying degrees; e.g., stock, medium, final and various phases of CMP. This machine is also compact, easy to service, and cost effective. Thus, all market segments can be supplied with a wide ranges of systems customized according to needs; e.g., low cost, high throughput, small footprint, variable, programmable simultaneous process cycles, variable hardware configurations and so forth, or a combination thereof.

In one embodiment, a system of the present invention includes a machine base; a frame associated with the machine base; at least one polishing unit associated with the frame; means for coupling/decoupling mechanically associated with the at least one polishing unit; means for horizontal transfer of the polishing unit, the means for horizontal transfer mechanically associated with the frame and the at least one polishing unit; at least one head for accommodation of the at least one wafer, the at least one head independently associated with the at least one HTR and the at least one polishing unit; and at least one platen mechanically associated with the machine base whereby the means for coupling/decoupling automatically couple and decouple the at least one head to and from the at least one polishing unit.

Various embodiments also include, alone or in combination, components for stock, medium, final, chemical mechanical planarization (CMP) polishing; single head wafer polish; polishing units to which two heads can be coupled and decoupled therefrom; single or multiple platens; a wafer transfer robot (WTR) for supporting a cassette having a plurality of wafers; cassette platform having, for example, wet in-wet out cassettes (cassettes in water tanks to optimize wafer-polishing results); one or more cleaning stations for cleaning wafers; a wafer loading/unloading mechanism (WLM) for automated loading of the wafers into and from the heads; one or more buffers for temporary accommodation the heads; and one or more pad dressers for grooming the platen between polishing cycles.

A method for polishing a set of wafers with a system having a machine base, a frame mechanically associated with the machine base; at least one platen, at least one polishing unit, at least two polishing heads, each polishing unit having means for coupling/decoupling with the heads and having means for horizontal transfer of the polishing unit; and at least one HTR is provided, wherein the method comprises the steps of polishing a first subset of the set of wafers, whereby the first subset of the set of wafers is contained in the first of the at least two polishing heads; replacing the one of the at least two polishing heads having the first subset of the set of wafers from the first of at least one polishing unit with a second of the at least two heads having a second subset of the set of wafers; contemporaneously polishing the second subset of the set of wafers and transferring the first of at least two heads to a position whereby the first subset of the set of wafers is replaced with a new subset of the wafers to be polished; e.g., if there are three heads then this would be the forth subset of the wafers.

Further advantages of the invention will be brought out in the following portions of the specification, wherein the detailed description is for the purpose of fully disclosing preferred embodiments of the invention without placing limitations thereon.

BEST MODE FOR CARRY OUT THE INVENTION

Figure 1:
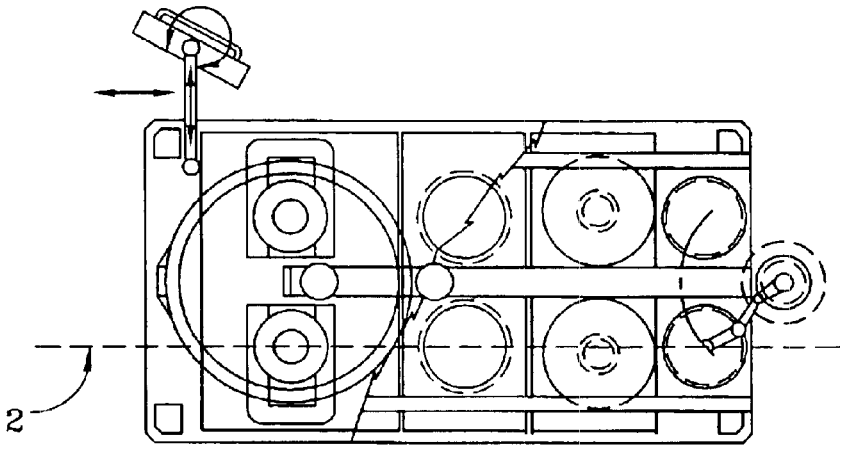
Figure 1 (Prior Art)
FIG. 1 is a schematic of a plan view of a polishing machine of the prior art having a linear processing path.
Figure 2:
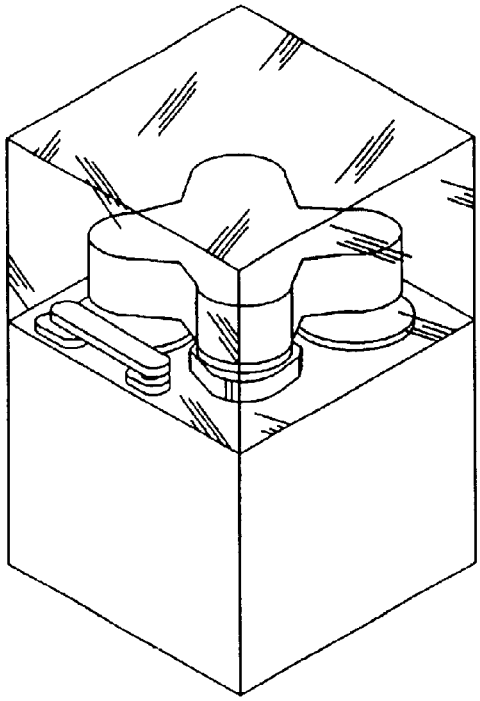
Figure 2 (Prior Art)
FIG. 2 is an illustration of a plan view of another polishing machine of the prior art.
Figure 3:
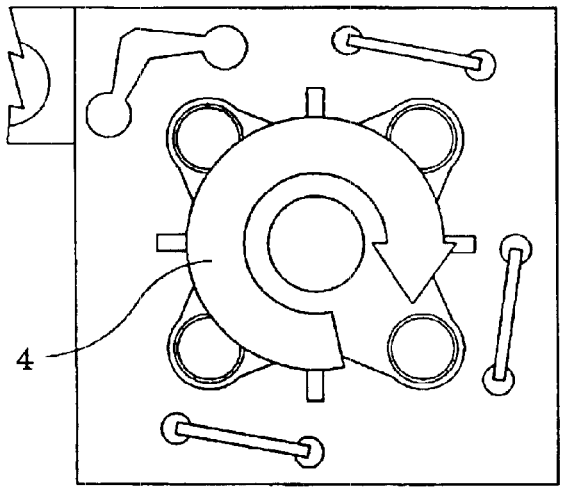
Figure 3 (Prior Art)
FIG. 3 is an illustration of a plan view of another polishing machine of the prior art.
Figure 4:
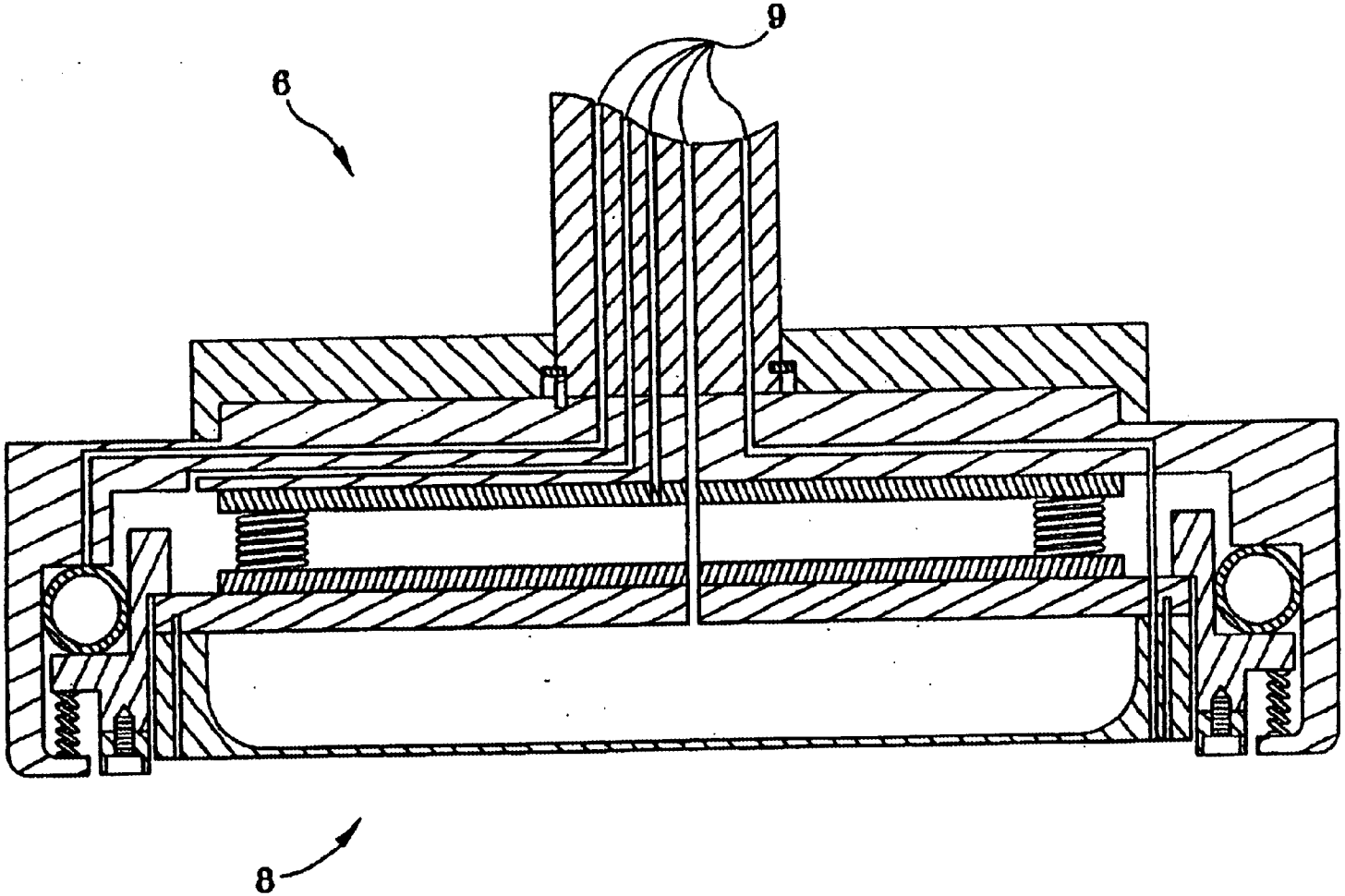
Figure 4 (Prior Art)
FIG. 4 is illustration of a polishing unit of the prior art and having an integral head and a network of conduits irremovably distributed from the polishing unit into its integral polishing head.
Figure 5:
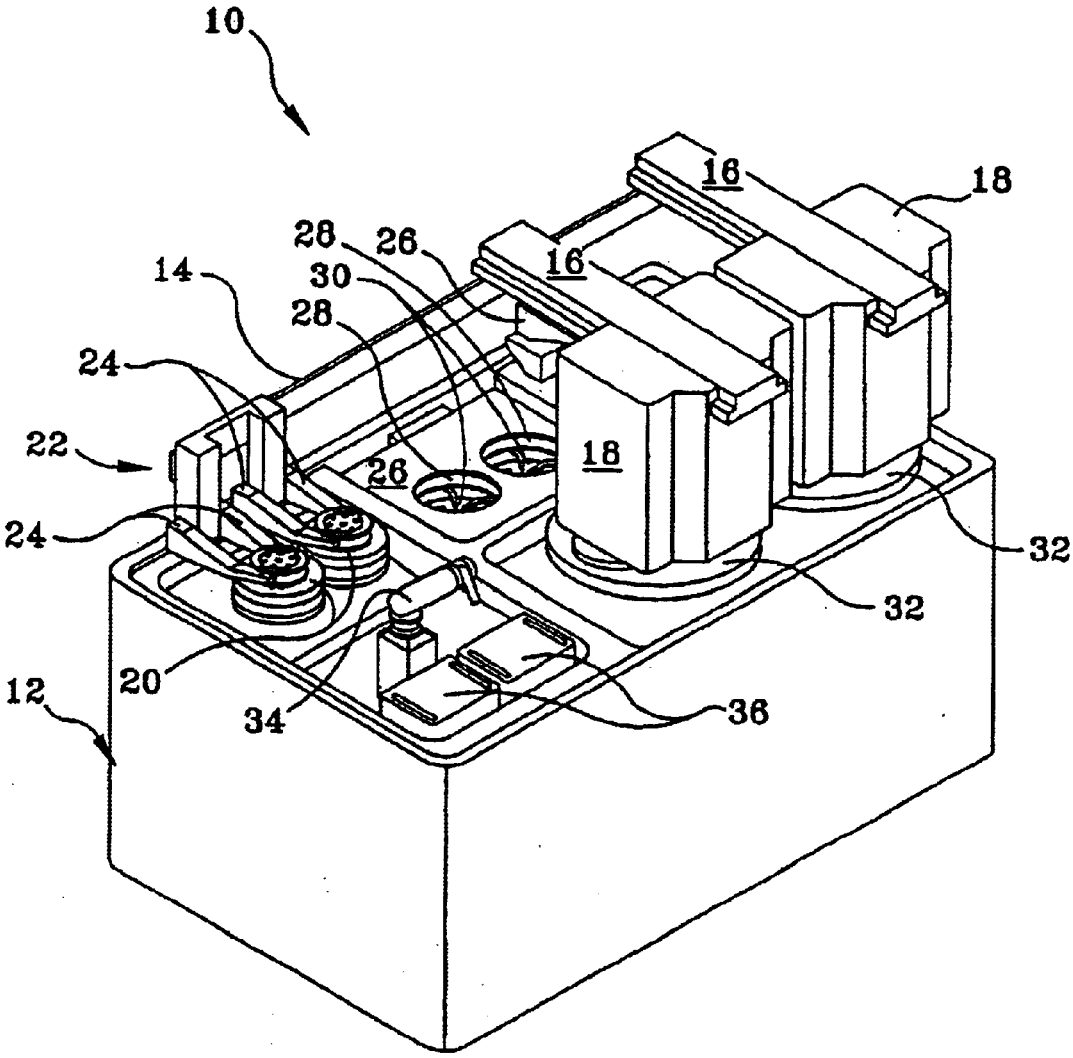
FIGS. 5 and 6 are illustrations of a polishing machine according to the present invention.

Referring specifically to the drawings, wherein like references are made to the same items throughout, for illustrative purposes the present invention is generally embodied in the apparatus depicted in FIG. 5, as contrasted to the drawings of the prior art in previously referenced as FIGS. 1, 2, 3 and 4. A skilled artisan will appreciate that the apparatus and method may vary as to the details referenced herein, and that the method may vary as to the specific steps and sequence, without departing from the basic concepts as disclosed herein. Further, one skilled in the art will recognize that the methods and apparatus of the present invention contemplate use of various components, alone or in combination.

Figure 6:
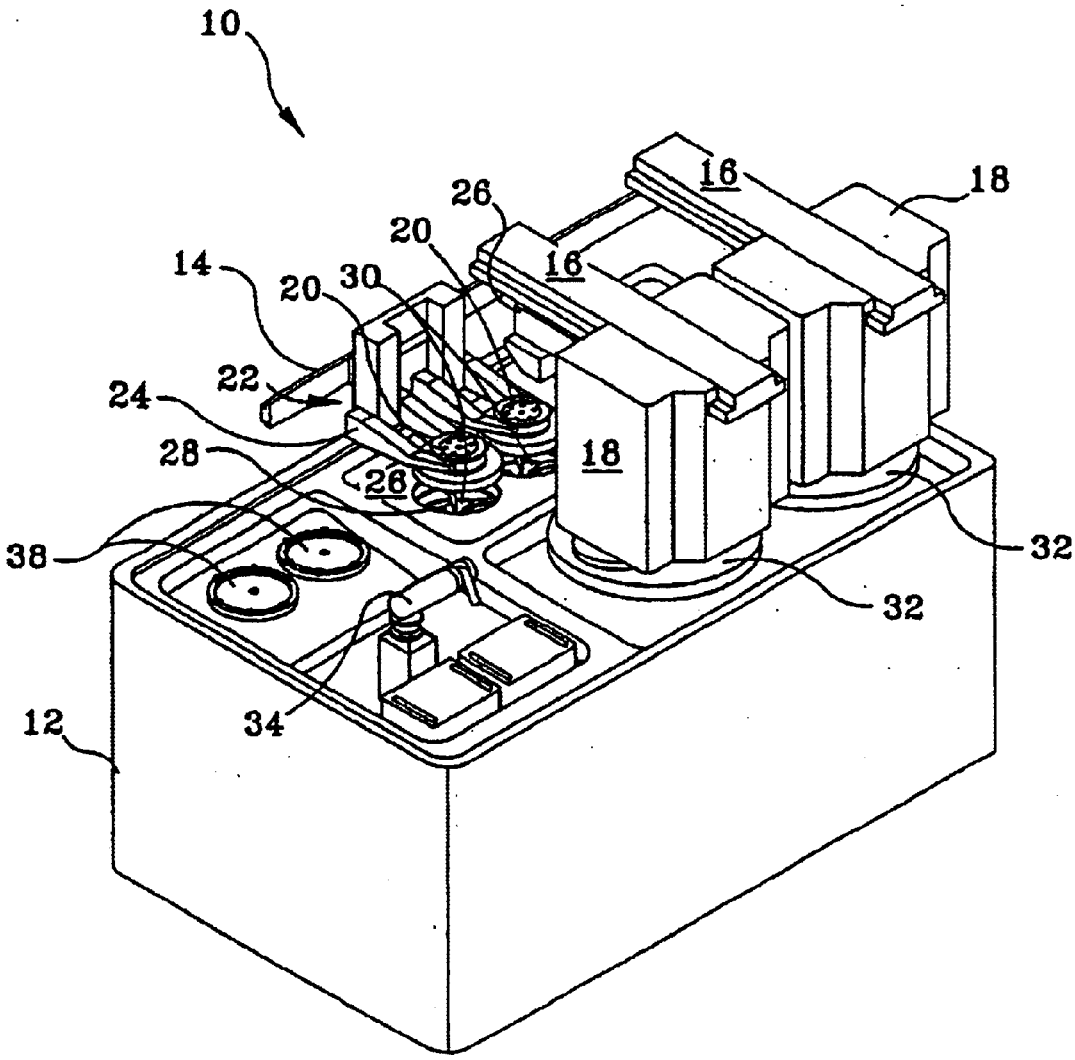

Turning now to FIGS. 5 and 6, there are shown generally at 10 an embodiment of a polishing machine of the present invention having a machine base 12 and a frame 14 mechanically associated therewith. The machine base 12 and the frame 14 are firmly connected to each other and represent one generally solid structure. All other components of the machine are located relative to both of them. Both of them could be referred to interchangeably. There are means for horizontal transfer 16. One or more polishing units 18 are translated between various positions by the means for horizontal transfer 16. Each polishing unit 18 has means for coupling and decoupling (not shown). As described in greater detail hereafter, each means for coupling/decoupling is mechanically associated with a respective polishing unit 18, and provides the functionality for automatically coupling and decoupling interchangeable, independently mobile heads 20. In this example, each polishing unit 18 is configured with means for coupling/decoupling.

The two polishing units 18 are translated along respective means for horizontal transfer 16 attached to the frame 14. Such translation positions and repositions the polishing units 16 at points along a predetermined path. Means for vertical transfer of the polishing unit heads (not shown) are widely known in the industry. Most generically they are shafts 40 in FIG. 9. Such means for vertical transfer are integral to or mechanically associated with each polishing unit and raise and lower each polishing unit head 20 according to a predetermined objective; e.g., the polishing unit 18 is translated along a path to a point directly above a pair of heads 20, whereafter the means for vertical transfer lowers the polishing unit shaft (shown in FIG. 9 at 40) for coupling of the heads 20 to the polishing unit via the means for coupling/decoupling.

Figure 7:
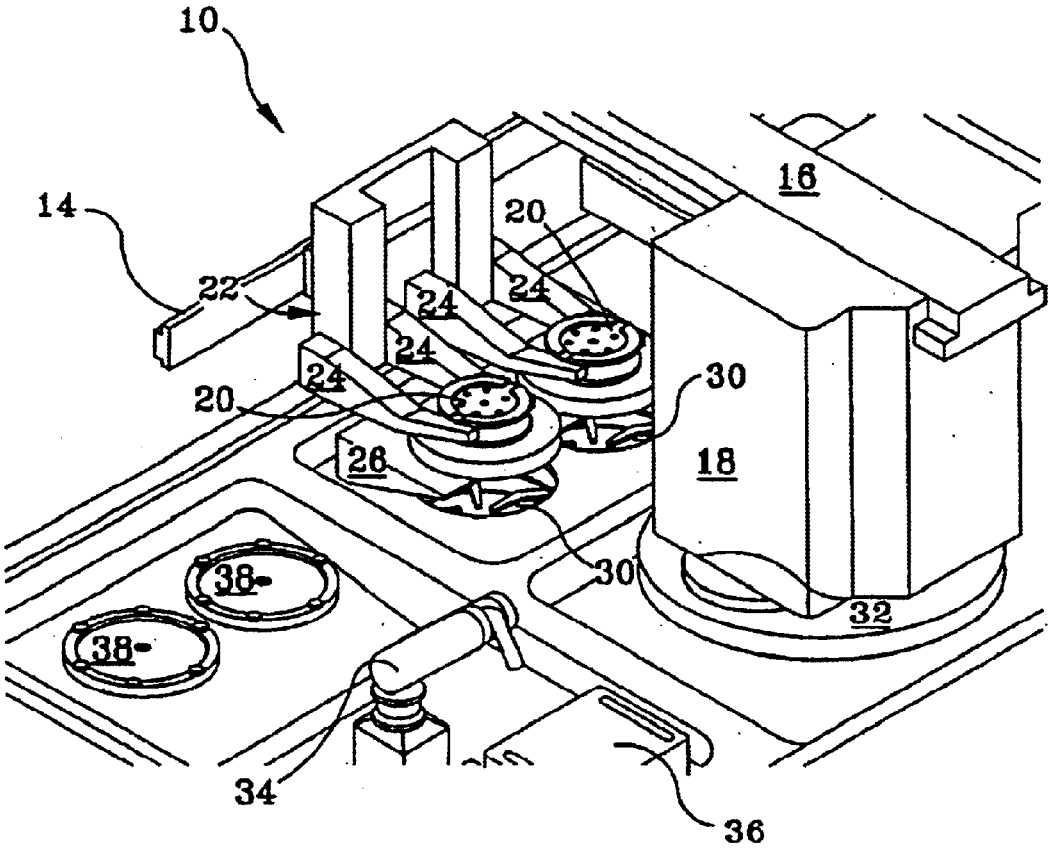
FIG. 7 is an illustration of a portion of the polishing machine of FIGS. 5 and 6, including the HTR and buffers, according to the present invention.

With further reference to FIGS. 5–7, there is shown a HTR 22 (Head Transfer Robot) having at least one means for holding (to grip, grasp, just hold, or provide similar functionality) such as a pair of arms 24 and means for repositioning (not shown) mechanically associated with the frame 14. The means for repositioning (not shown) translate the HTR 22 along a predetermined horizontal path consistent with the frame 14 and, in embodiments having buffers 26, are consistent therewith. In various embodiments, the HTR 22 may also include means for vertical transfer to permit raising and lowering of the pair of arms 24 and other functionality. Each buffer 26 generically functions to temporarily hold one or more heads. In FIGS. 5 and 6, the buffer 26 forms an aperture 28 therein but the buffer 26 could also comprise other means for accommodating a head 20; e.g. as in FIGS. 8*a* and 8*b*, where there are shown three posts with a recess for the head (buffer holder 56). Means for vertical travel (not shown) associated with each buffer raise and lower the buffer (with or without heads deposited therein) to facilitate clear passage of the HTR 22 and its pairs of arms 24. Alternatively, the buffer, the HTR or both can be raised or lowered to ensure clearance for all components proceeding through various processing cycles. One or more cleaning stations 30 provide head cleaning functionality; e.g., a rotating brush on a spindle or a water nozzle that cleans a head 20 after a polishing operation and unload of a wafer from the head 20. Further, the HTR 22 with its arms 24, buffer 26 and its buffer holder (shown in FIGS. 8*a* and 8*b* at 56) and cleaning stations 30 have designs that preserve the rotational orientation of the heads; e.g., means for rotational alignment. This preservation is provided so that once any head 20 is removed from any polishing unit 18, the head 20 will return to this or other polishing units 18 in the same or different but predetermined orientation that facilitates head mating between the media of the head 20 with corresponding details of the polishing unit e.g., channels for media, locating pins, etc. One or more platens 32 provide various polishing operations for a surface of the wafer. WTR (wafer transfer robot) 34 and one or more cassette platforms 36 interact to load and unload wafers to and from the cassette platform 36. The WTR 34 further functions to transfer wafers to a wafer loading/unloading mechanism (WLM) 38 for automated loading and unloading of the wafers into heads 20 when the heads are separated from the polishing unit. A skilled artisan will note that other components may be added in various combinations and in various configurations to promote versatility of multiprocessing, optimize throughput, an so forth. For example, in various embodiments, the cleaning stations 30 may be located adjacent to the WLM 38 or at other locations of the machine. Also, various embodiments do not necessarily involve brushes; other means of cleaning, e.g. spray of DI water, could be used.

Figure 8A:
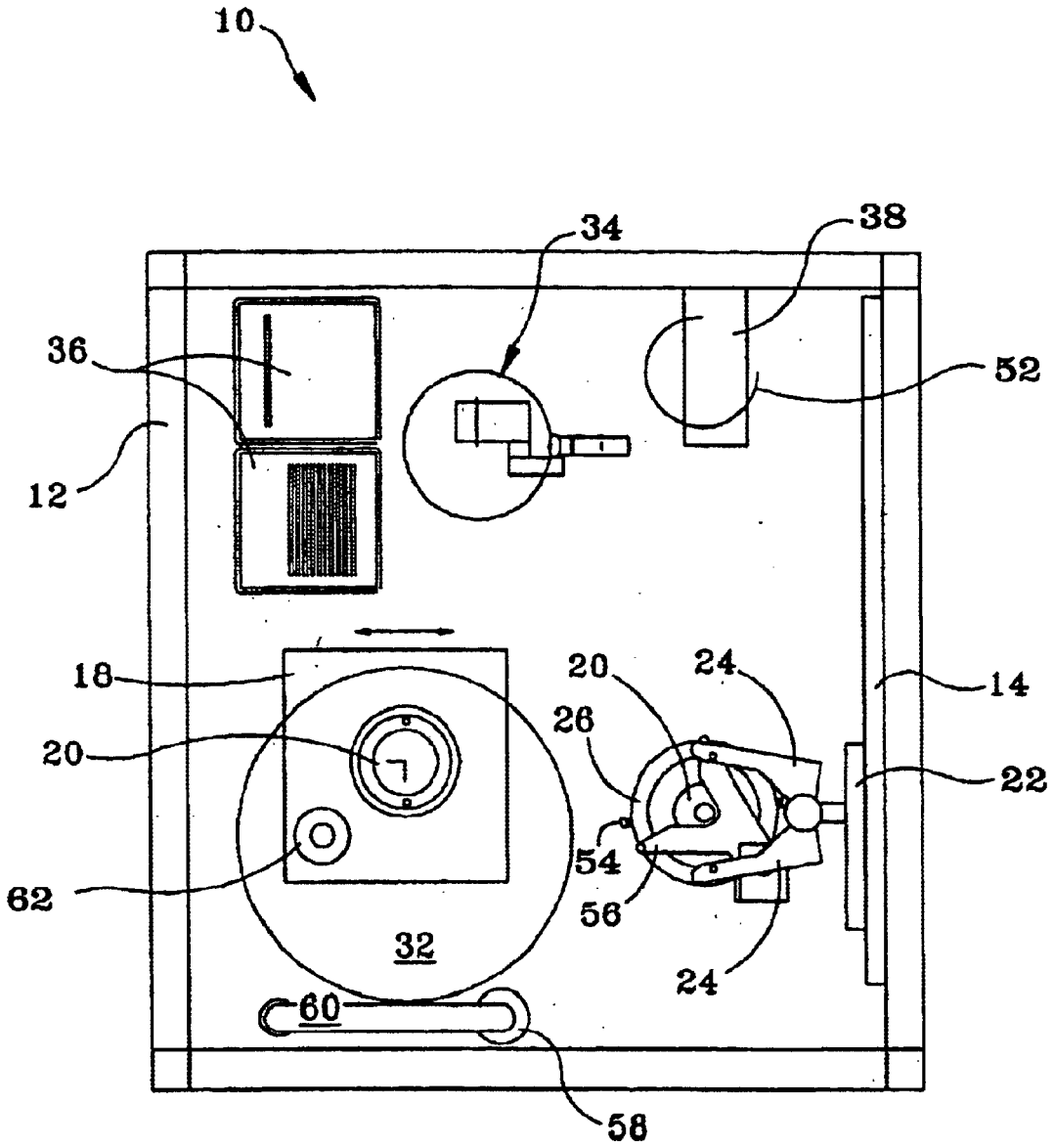
FIGS. 8*a* and 8*b* are schematics of plan views of a polishing machine with various head configurations according to the present invention.
Figure 8B:
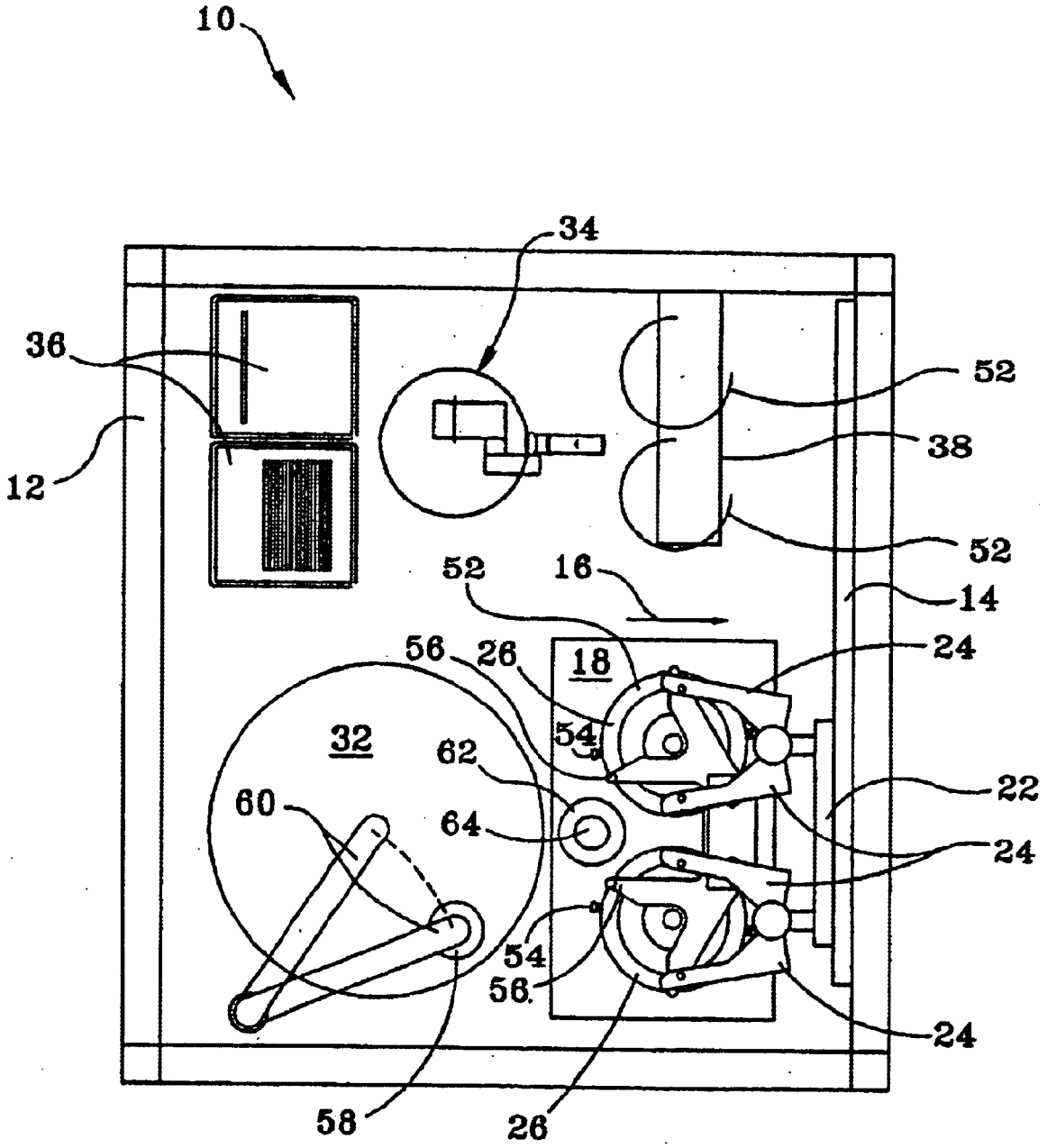

With reference now to FIGS. 8*a* and 8*b*, there are shown schematics of a plan view of a polishing machine 10 according to the present invention. FIG. 8*a* provides for a machine having a machine base 12, cassette platforms 36, WTR 34, WLM 38 and its associated head holder 52. The head holder 52 serves to hold the heads and provide other functionality such as supply a vacuum, air, etc. The polishing unit 18 and a pad dresser disk are shown removably located in a position relative to platen 32. A separate pad dresser disk 58 and its associated lever further provide pad dressing services for the platen 32. The horizontal means for transfer is shown at 16, along with the HTR 22 with its pair of arms 24, and the frame 14. Two heads 20 are shown, one coupled to the polishing unit 18 and the other located in the buffer 26 in its lower position. Upon completion of polishing, for example, the polishing unit 18 transfers the head coupled thereto to the HTR 22 and its pair of arms. The HTR shuttles its payload to the WLM 38 for further processing. Meanwhile the buffer 26 rises to its high position to rendezvous with the polishing unit, and the means for coupling/decoupling 40 couple the head from the buffer 26 to the polishing unit 18.

FIG. 8*b* provides for the machine having a machine base 12, cassette platforms 36, WTR 34, WLMs 38 and their associated head holder 52. Also shown are the polishing unit 18, its associated means for horizontal transfer 16, HTR 22 with its pair of arms 24 and frame 14. A pair of brushes 54, each associated with a cleaning station 30 and used to clean the heads 20 is provided. The pair of buffers 26 is supported by, for example, a three-point buffer holder 56. Several types of pad dresser disks for dressing the platen are shown, one pad dresser disk 58 supported by lever 60 and the other pad dresser disk 62 supported by a vertical shaft 64 associated with polishing unit 18.

Figure 9:
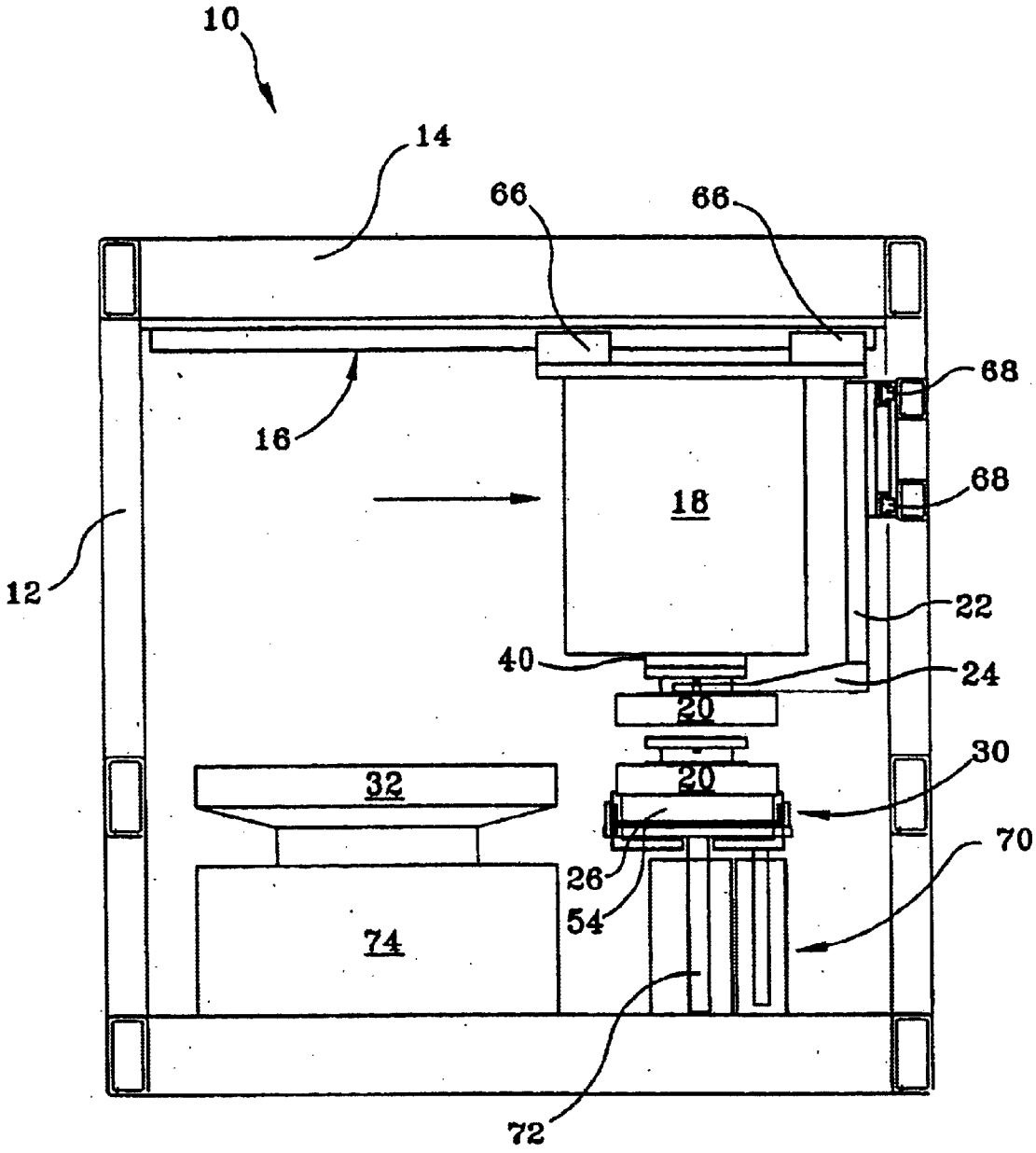
FIG. 9 is an illustration of a side view of a polishing machine according to the present invention.

Turning now to FIG. 9, there is shown in cross-section a schematic of a polishing machine 10 according to the present invention having a machine base 12; frame 14; polishing unit 18 having means for coupling/decoupling 40 with associated polishing unit slides 66 for translation, and HTR 22 having the pair of arms 24 and HTR slides 68 for translation. One head 20 is shown coupled to the means for coupling/decoupling 40 at the beginning of the transition process from the polishing unit 18 to the HTR 22 and its pair of arms 24. Meanwhile a simultaneous process proceeds whereby buffer 26 having means for vertical travel 70, whereby the buffer 26 is shown is a low position relative to the HTR 22 and its pair of arms 24, and the buffer accommodates a second head 20. The brush 54 of the cleaning station 30 is shown with rotation means 72, whereby the brush is spun to effect cleaning of second head 20 residing in the buffer 26. Upon completion of the aforementioned decoupling process of the first head 20 from the means for coupling/decoupling 40 and into the pair of arms 24 of the HTR 22, the HTR 22 relocates to a position away from the buffer 26, whereafter the means for vertical travel 70 raises the buffer 26 and the second head 20 for immediate rendezvous with the means for coupling/decoupling 40 of the polishing unit 18.

Figure 10:
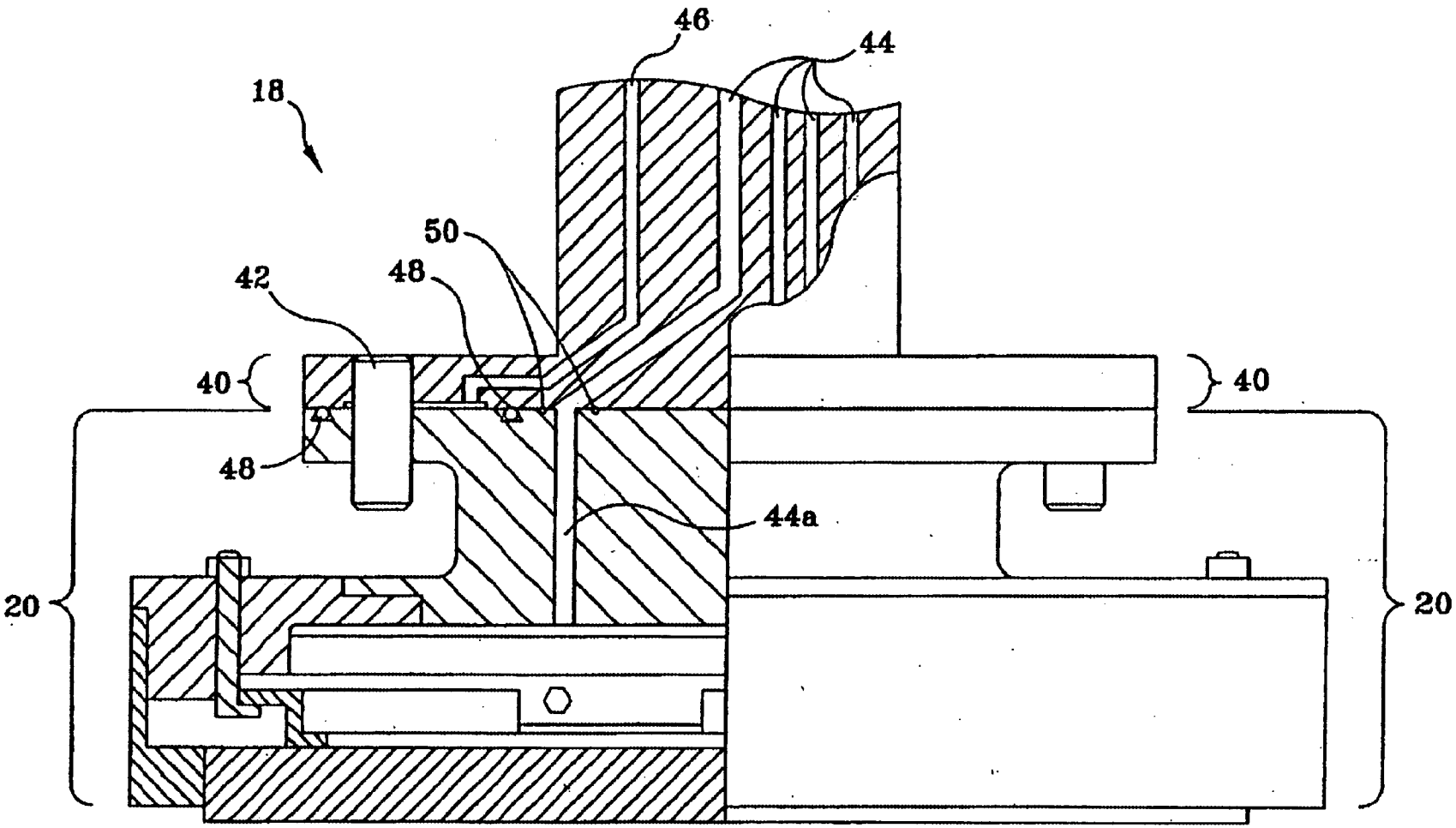
FIG. 10 is an illustration, including a partial cross section and a side view, of a portion of a polishing unit having vacuum means for coupling/decoupling according to the present invention, wherein a head is coupled thereto.

The means for coupling/decoupling 40 is shown in greater detail in FIG. 10, where there is shown in cross-section an illustration of a polishing unit 18 having means for coupling/decoupling 40, wherein a head 20 is attached thereto. The means for coupling/decoupling 40 include, for example, means for alignment such a pin 42. The pin 42 fixes and aligns the head 20 with the polishing unit 18 such that corresponding components of the polishing unit 18 and the head 20 are aligned correctly; e.g., a conduit 44 of the polishing unit aligns with a conduit of identical functionality 44*a* of the head to complete the artery necessary to carry out portions of the polishing operations. Means for connect/disconnect illustrated herein as vacuum means 46 draws the head 20 to the polishing unit 18 whereafter an o-ring 48 facilitates formation of a seal therebetween. For example, the polishing unit 18 translates along the means for horizontal transfer 16 until it is positioned over the head 20 cradled in the aperture 28 of the buffer 26. The buffer 26 rises to a height where contact is made between the means for coupling/decoupling 40 and the head 20. The pins 42 engage and align the head 20 such that all corresponding components 44, 44*a* of the polishing unit 18 and head 20 are aligned. A vacuum is created via the means for connect/disconnect 46 adhering the head 20 to the polishing unit 18 at the means for coupling/decoupling 40. The two o-rings 48 enable a seal therebetween. This entirely automated means of coupling can be accomplished in an extremely short period of time, allowing the polishing process to continue; e.g., the polishing unit is relocated to the platen and the corresponding parts 44, 44*a*, of the polishing unit 18 and the head 20, respectively (with a seal therebetween facilitated by an seal facilitator 50 such as a third o-ring) provide compressed dry air (CDA) into internal compartment of the polishing head 20. Other channels can provide a vacuum for the head functionality or dionized water (DI) for cleaning the head, etc. Similar to the coupling process, decoupling is quickly and easily accomplished merely by predetermined function of the means for connect/disconnect; e.g., elimination of the vacuum of the vacuum means 40, thus disengaging the head. Of note, during each coupling, decoupling, polishing or other processing step, the wafer remains protected by the head, thus virtually eliminating damage to the wafer.

Figure 11:
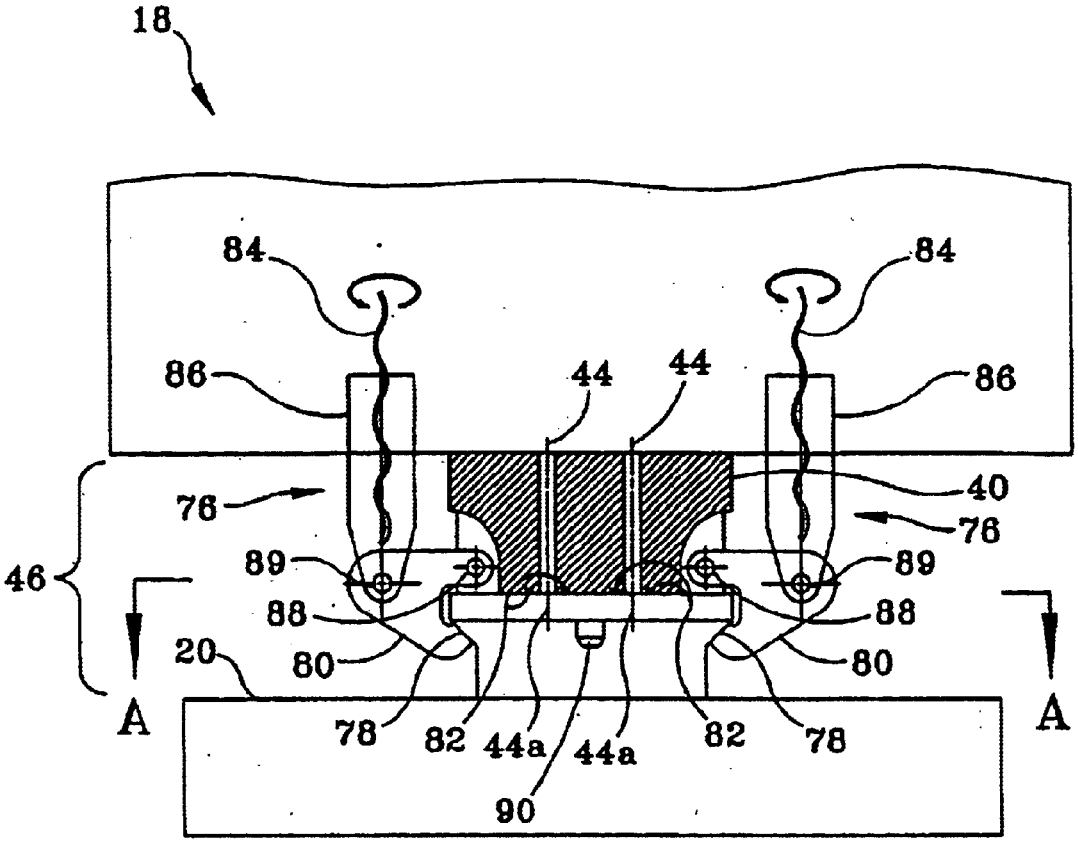
FIG. 11 is an illustration of a side view of a portion of a polishing unit having latch means for coupling/decoupling according to the present invention, wherein a head is coupled thereto.
Figure 12:
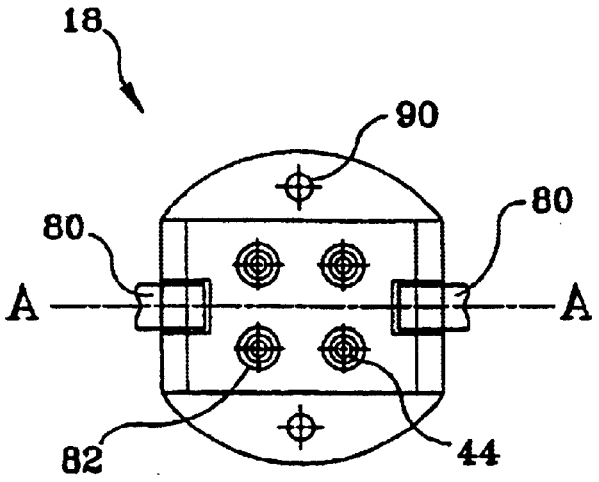
FIG. 12 is a cross-section of FIG. 11 taken along Line A.

Turning to FIGS. 11 and 12, there are shown another means for coupling/decoupling 40 that includes means for connecting/disconnecting 46 embodied as a latching means. The polishing unit 18 is shown in portion with means for latching shown generally at 80 that couples the head 20 having a flat surface 78 to the polishing unit 18. The flat surface 78 of the head 20 interacts with the latches 80. An actuator (partially shown as 76) controls the means for latching 80. Actuator 76 consists in this embodiment of screws 84 and nuts 86. A drive for rotating the screw 84 is not shown. Latches 80 attach to the shaft 40 of the polishing unit 18 by axes 88 and attach to actuator 76 by axes of 89. Seals 82 seal the connection between the passages 44*a* of the head 20 and passages 44 of the shaft 40 of polishing unit, when coupled, they provide conduits for compressed air, a vacuum, deionized water, etc., to the head. They are aligned and functional; therefore, the polishing unit 18 with head 20 attached thereto may seamlessly proceed with any desired process step in a processing cycle while keeping the wafer intact. When the head 20 is decoupled from the polishing unit 18 via the actuator 76 and transferred to the pair of arms 24 of the HTR 22, one or more gripper pins 90 connect with the pair of arms 24 of the HTR 22, and the processing cycle continues. Similar to the vacuum means 46 used to couple/decouple heads from the polishing unit, the latching means 76 provide for the automated, extremely fast rotation of independent mobile heads to/from various polishing units 18 and/or the HTR 22 while providing complete protection for wafers housed therein. One skilled in the art will appreciate that means for coupling/decoupling; means for alignment and means for connect/disconnect may be designed and implemented according to various components or combinations thereof, so long as the functionality described herein in is carried out.

Figure 13:
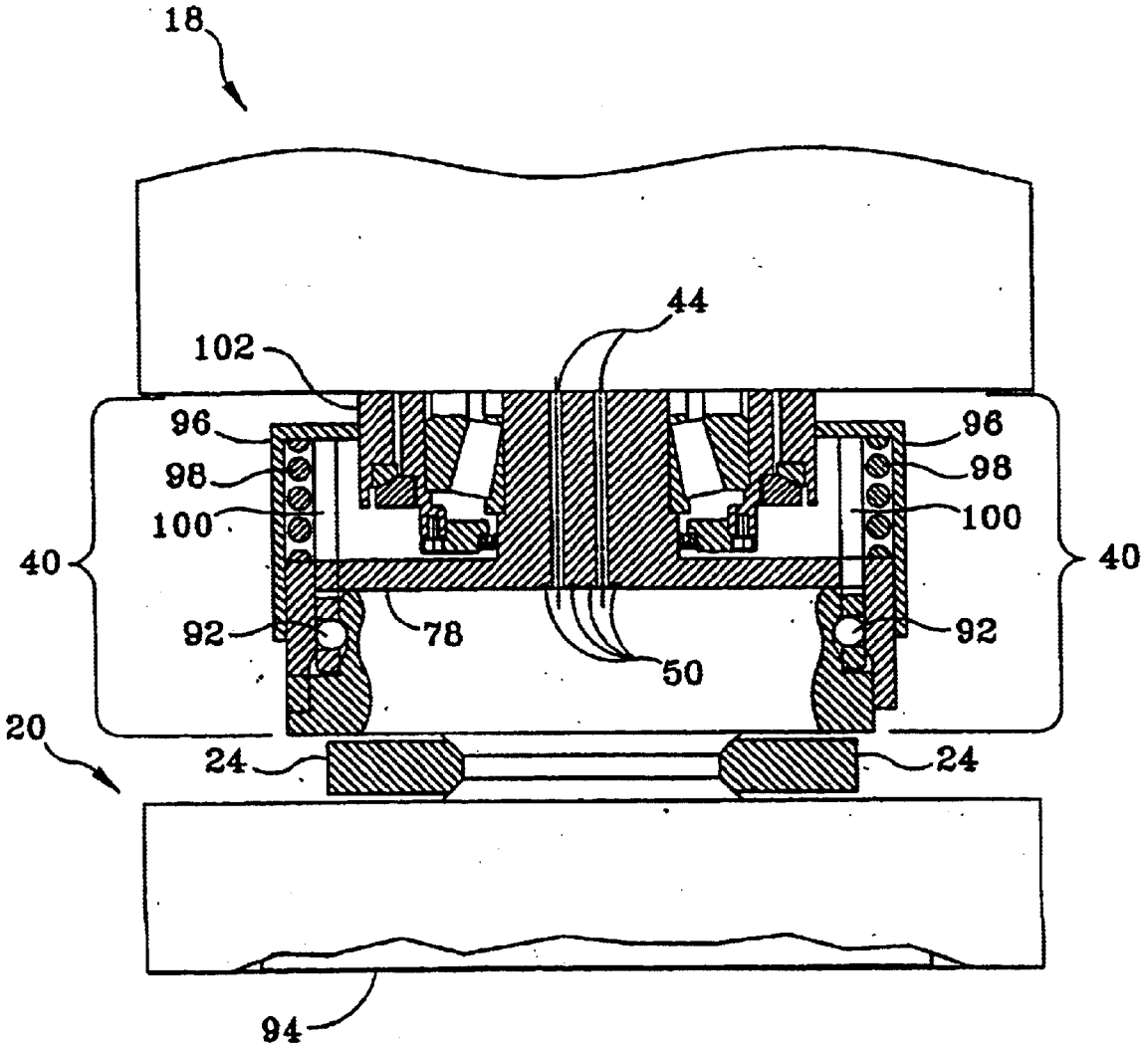
FIG. 13 is an illustration, including a partial cross section and a side view, of a portion of a polishing unit having locking balls in a separator as means for coupling/decoupling according to the present invention, wherein a head is coupled thereto.

With reference to FIG. 13, there is shown, yet another means for coupling/decoupling similar to standard design of tool exchangers used on most milling machines. It includes a ball means as seen with a polishing unit shown in portion at 18 with a head 20 coupled thereto. The head 20 (loaded with a wafer 94) has a flat surface 78 interfacing with the means for coupling/decoupling shown generally at 40. The means for coupling/decoupling include ball means such as locking balls 92 for attachment of the head 20 to the polishing unit 18. A housing 96 is associated with ball springs 98 and at balls holders 100, whereby the spring tension associated with the ball springs 98 relative to the locking balls 92 interact to lock and unlock the locking balls 92 in the balls holder 100, thus coupling and decoupling the head 20 (with or without wafer 94) to the polishing unit 18, and sealing the corresponding components 44, 44*a* (not shown) via sealing facilitators 50 to conduit the components and permit normal polishing operations via various conduits; e.g., vacuum, DI, etc. In this example, the means for gripping; i.e., the pair of arms 24 of the HTR 22 are shown grasping the head 20 to facilitate transfer of the head 20 to the polishing unit 18 or to receive the head 20 therefrom. As shown, head 20 is coupled to the shaft 102 of the polishing unit 18 by locking balls 92. To decouple the head 20 from the polishing unit 18 vertical lift of the shaft 102 of the polishing unit,18 drives shaft 102 up; i.e., inside of, the polishing unit 18 to the point where an upper surface of the coupling/decoupling housing 96 barely touches a lower surface of the polishing unit 18. Starting from this point with continuation of the shaft 102 moving inside polishing unit 18, the spring 98 is further compressed, and separator 100 with locking balls 92 being pushed down by housing 96 go out of the smaller inside diameter of the shaft 102. When the balls 92 reach the larger inside diameter of the shaft 102, then the balls 92 go out of the groove on the head 20 and their locking function ends—head 20 is decoupled and can be taken from the polishing unit 18 by HTR 22 or could be left in a buffer 26.

The system of the present invention, by virtue of its multiple component configuration possibilities coupled with its functionality to multiprocess without interference between polishing units, platens, or mechanical components, offers an incomparable number of configurations and multiprocessing cycles permutations. The following are illustrative of several component configurations and multiprocessing cycle examples.

Figures 14, 14A:
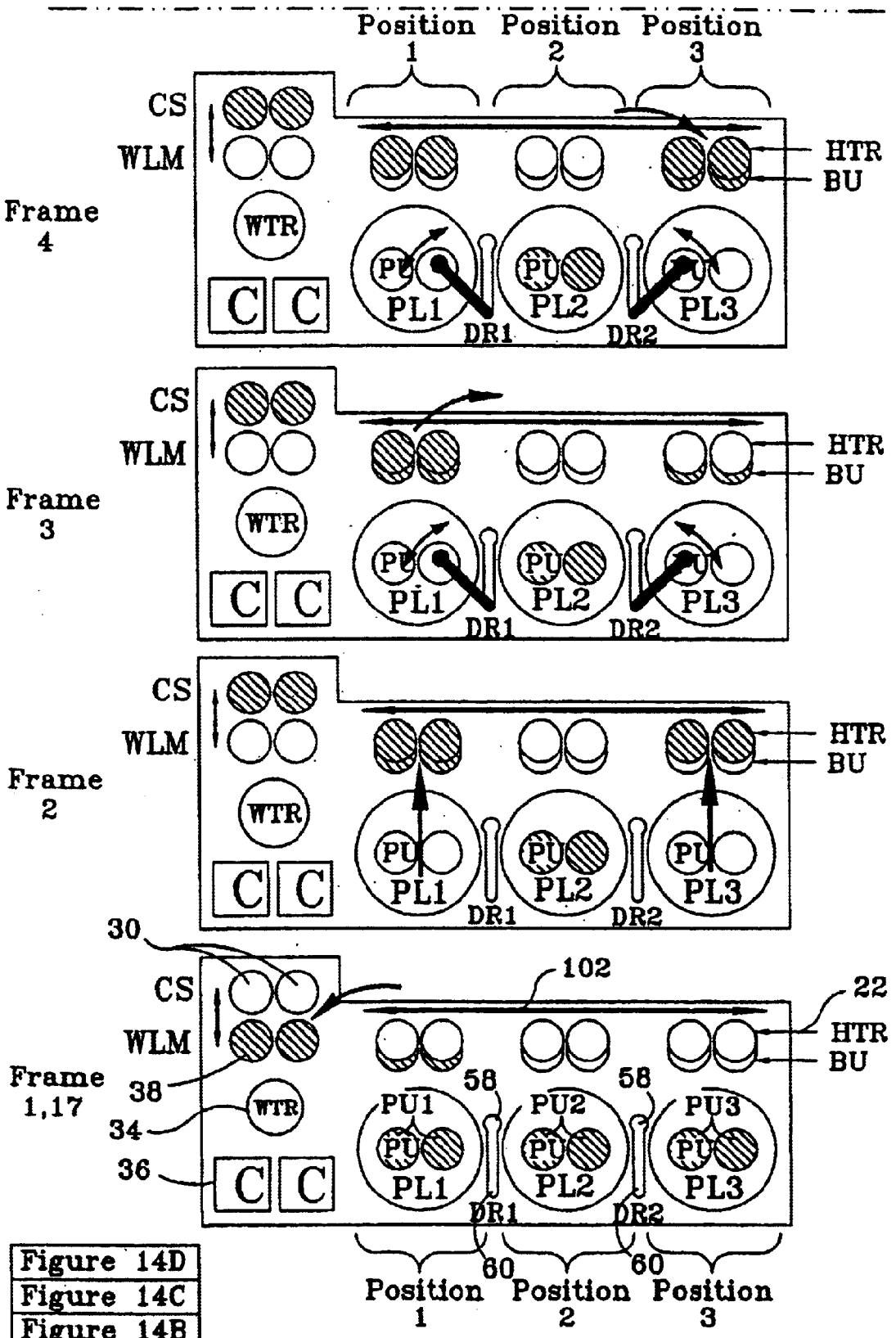
FIG. 14 is a series of frames of a schematic of a plan view of a polishing machine according to the present invention with three platens and five sets of heads showing an entire cycle of processing steps for a two-step parallel polishing.
Figure 14B:
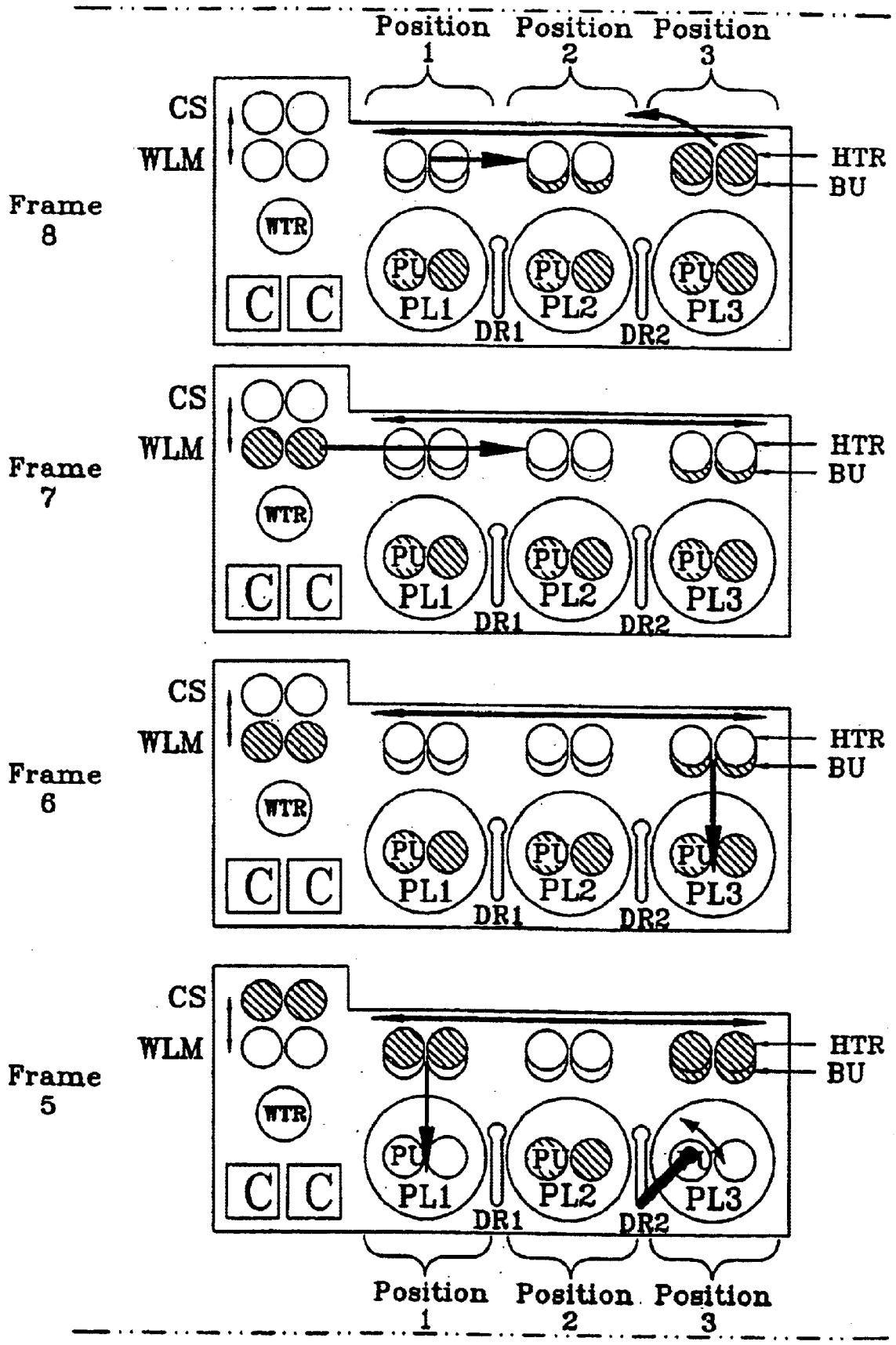
Figure 14C:
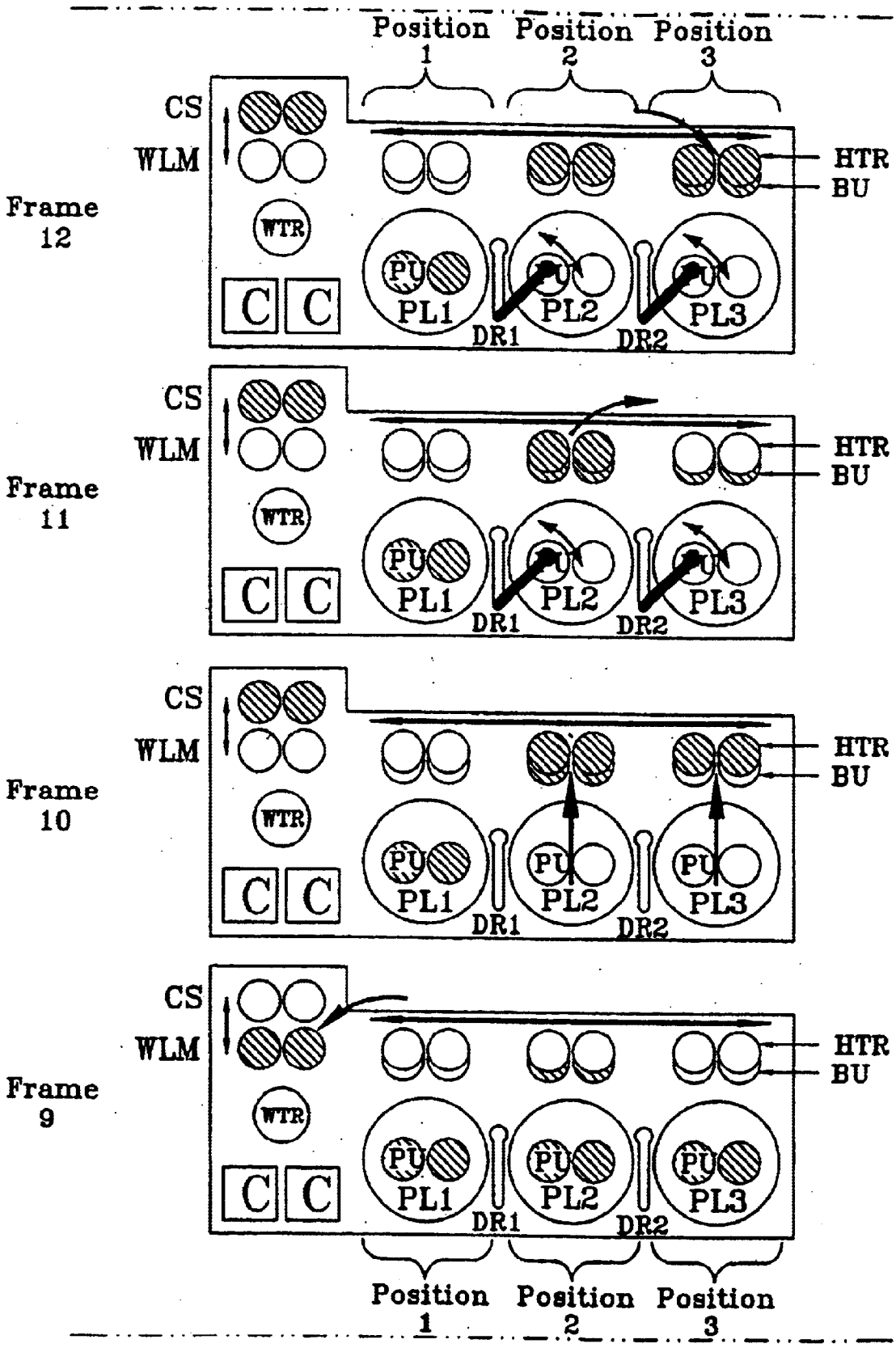
Figure 14D:
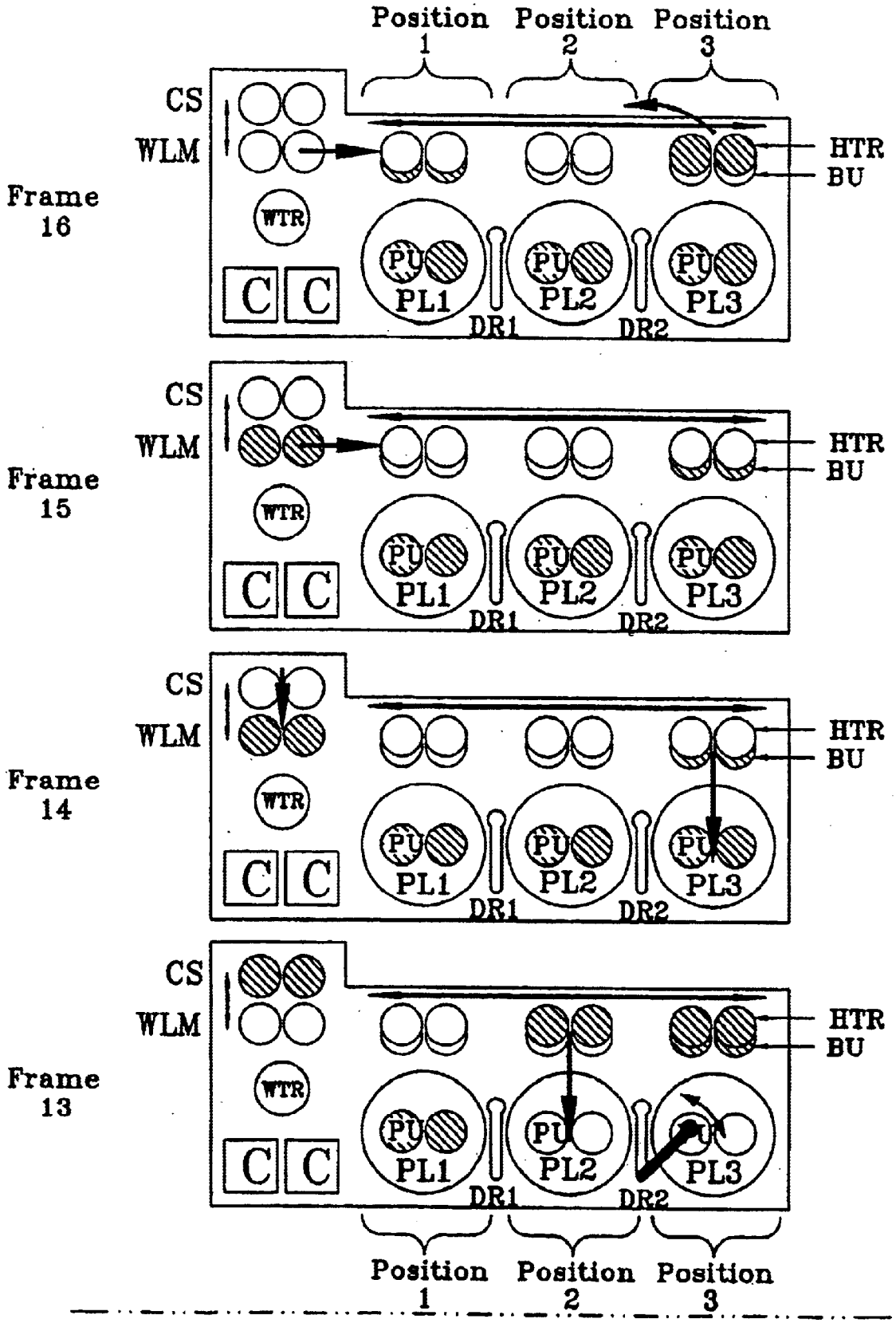

With reference to FIG. 14, there is shown a schematic illustration in frames of various polishing cycles relative to a machine of the present invention having three platens and five pairs of heads, showing entire cycle of processing steps for each. The pairs of heads are depicted as diagonally lined circles (or partially visible diagonally lined circles), whereby each platen PL1, P2 and PL3 located in Position 1, Position 2 and Position 3 relatively, can accommodate a pair of polishing units 18, designated as PU1, PU2, and PU3. Three buffers, BU1, BU2 and BU3 located in Position 1, Position 2, and Position 3 relatively can each accommodate a pair of heads and can each elevate and lower from a high position to a low position. The frames also schematically depict two pad dresser disks 58 with lever 60, hereafter DR1 and DR2, respectively. The WLM 38 interacts with cleaning stations 30 and WTR 34, as heretofore described. The WTR 34 further interacts with cassette platforms 36 as described. The HTR 22 shuttles along the path depicted at 102, and between Positions 1, 2, 3, and the WLM 38, as described. The preceding positions and components apply to each frame, 1–17, in FIG. 14. The following description depicts one possible polishing cycle for wafers to cycle from stock polishing steps through final polishing steps, where the stock polishing time greatly exceeds the final polishing time. Each frame depicts one time slice during a processing cycle. Each event described in each frame can occur contemporaneously or not, in close time proximity or in overlapping time slices, as desired.

In frame 1, there is one pair out of five pairs of heads located at the WLM 38, at PU1, at B1 in a lower position, at PU2, and at PU3 respectively. PU1 and PU3 with coupled heads complete polishing and PU1 and PU3 rise from PL1 and PL3, respectively. PU2 is stock polishing.

In frame 2, PU2 continues to stock polish its coupled heads with wafers relative to PL2; PU3 translates to B3, which is in an upper position and ready to accept heads; PU1 brings its heads to HTR 22, where the wafers are unloaded into WLM 38 and the empty heads go to CS 30 for cleaning.

In frame 3, PU2 continues to stock polish; DR1 and DR2 are dressing PL1 and PL3; B3 brings heads to the low position; HTR 22 receives the heads from PU1, and transfers them to Position 3; cleaning of the heads continues in cleaning station 30; and wafers from WLM 38 are loaded into the cassette platform 36 by the WTR 34.

In frame 4, PU2 continues to stock polish its coupled heads with wafers relative to PL2; dressing of PL1 and PL3 by DR1 and DR3 respectively continues; B1 with heads raises to the upper position; and wafers from the cassette platform 36 are loaded into WLM 38.

In frame 5, PU2 continues to stock polish its coupled heads with wafers relative to PL2; dressing on PL1 stops; PU1 takes heads from B1 and goes to PU1 polishing position 1; PU3 picked up heads from HTR 22; and cleaned, empty heads are moved from cleaning station 30 to WLM 38.

In frame 6, PU2 continues to stock polish its coupled heads with wafers relative to PL2; PU1 with heads with wafers starts polishing; PU3 takes heads from HTR 22; HTR 22 then relocates to WLM 38; WLM 38 transfers wafers into heads.

In frame 7, PU2 continues to polish and PU3 with heads moves to PU3 and starts polishing; and heads from WLM 38 are moved by HTR to B2.

In frame 8, PU1, PU2 and PU3 are polishing; HTR 22 moves heads to B2, then HTR 22 relocates without heads to Position 3 and picks up heads from B3, then moves heads to WLM 38 position.

In frame 9, PU2 and PU3 stop polishing and rise from PL1 and PL3 respectively; PU1 continues stock polishing; one set of heads is located in B2 in lower position; HTR 22 moves heads to WLM 38.

In frames 10–frames 16, the sequence repeats itself as described above, with replacement of Position 1 to Position 2 and the cycle number is increased by 8; e.g., frame 10 is equivalent to frame 2, frame 11 is equivalent to frame 3, and so forth.

In frame 17, the entire sequence ends to repeat itself exactly; therefore, frame 17 is identical to the description of events occurring in frame 1.

Turning now to FIGS. 15–20, further configurations and multiprocessing cycles permutations are shown, wherein each Figure of FIGS. 15–20 like labels are used for components corresponding to those depicted in FIG. 14. Further, solid lines in each of FIGS. 15–20 represent movement of heads containing wafers and dashed lines represent shuttle path of empty HTR 22. Transfer of heads to or from the HTR 22 or to or from PU1, PU2, or PU3 is indicated at symbol 104 of FIG. 15. Progression of components according to time slices and paths are indicated as ordered by alphanumerics 1*a*, 1*b*, 2*a*, 2*b*, and so forth, whereby the numeric portions of the alphanumerics represent ordered, single time periods during a processing cycle. The alphabetic portion of the alphanumeric represents an ordered portion of time within its associated numbered time slice. Repetitive alphanumerics indicate to some degree contemporaneous events; e.g., polishing operation, pad dressing, and HTR 22 transfer.

Figure 15:
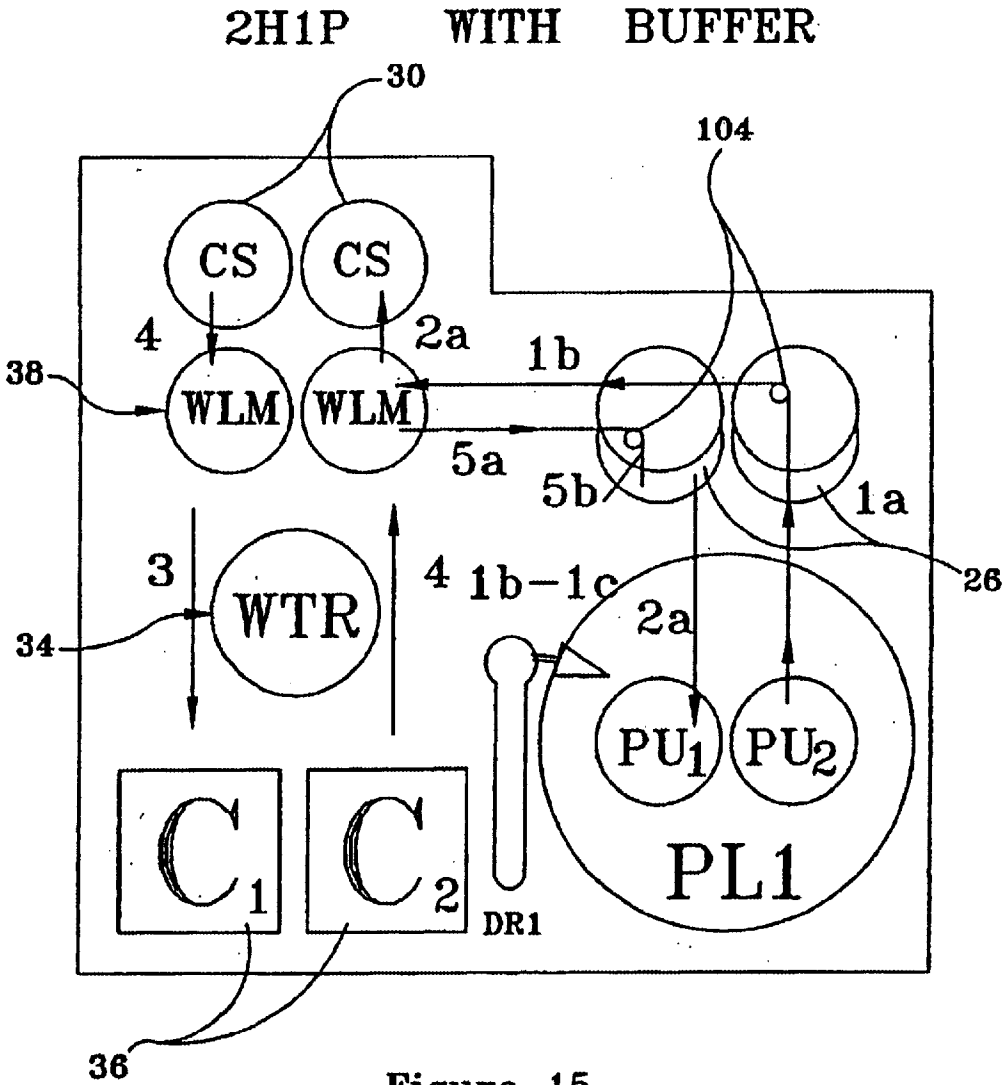
FIG. 15 is a diagram in plan view showing the processing steps of a machine of the present invention with one platen and two set of heads.

With respect to FIG. 15, there is depicted a schematic of a machine that includes two heads, one platen PL1, and a buffer 26. As depicted by 1*a*–1*b*, polishing completes on PU1 and PU2, and the heads are transferred to the HTR 22, and then shuttled to the WLM 38 for cleaning at step 2*a*, the cleaning station. During steps 3 and 4, the WTR 34 is transferring wafers to and from the cassette platforms 36. During time slice 5*a*–5*b*, the heads loaded with wafers are transferred by the HRT 22 from the WLM 38 to the upper HTR 22 position and then to the buffer 26 in lower position for temporary accommodation for further processing.

Figure 16:
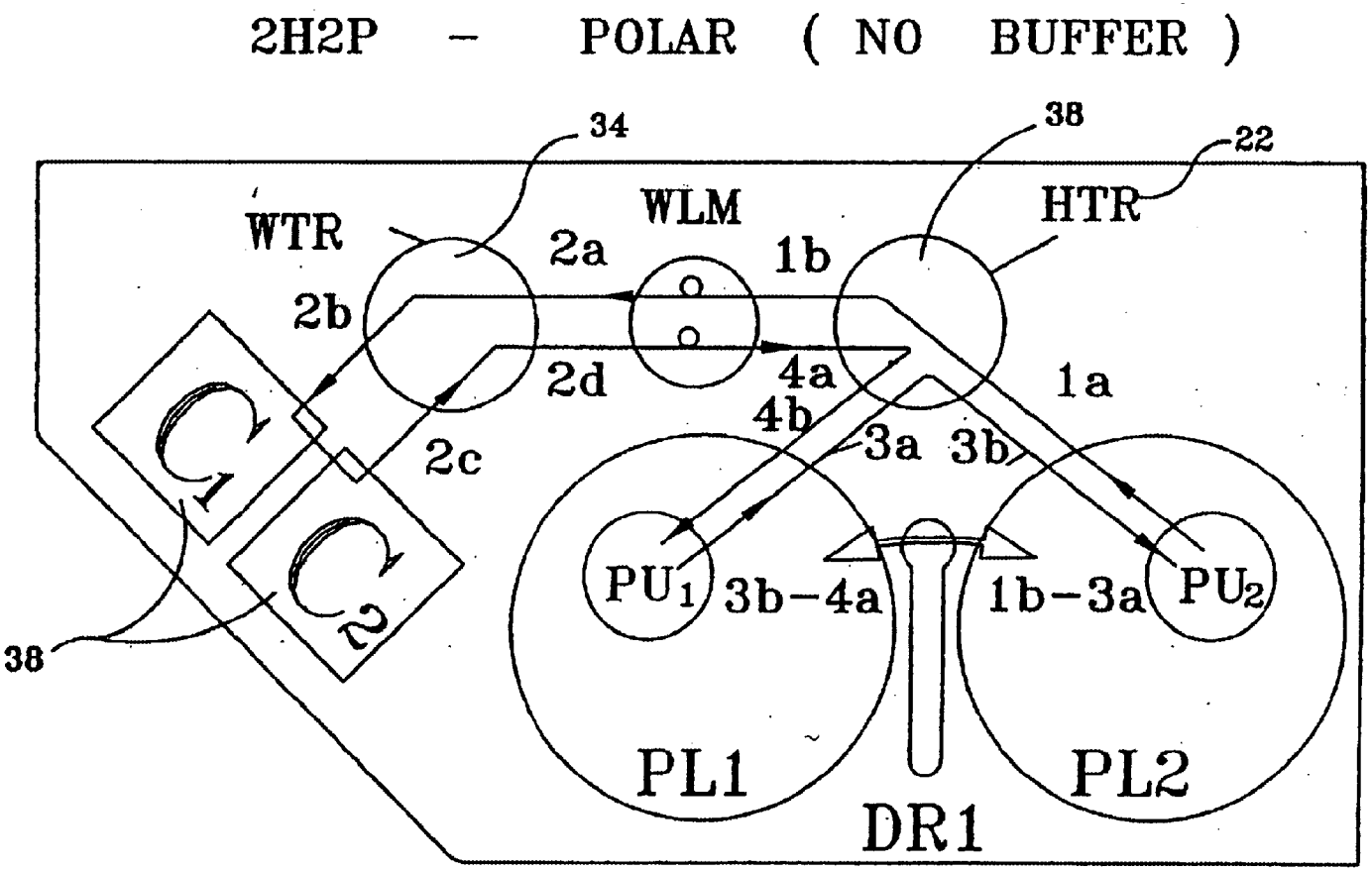
FIG. 16 is a diagram in plan view showing the processing steps of a machine of the present invention in radial (polar) configuration of the machine with two platens and two set of heads.
Figure 17:
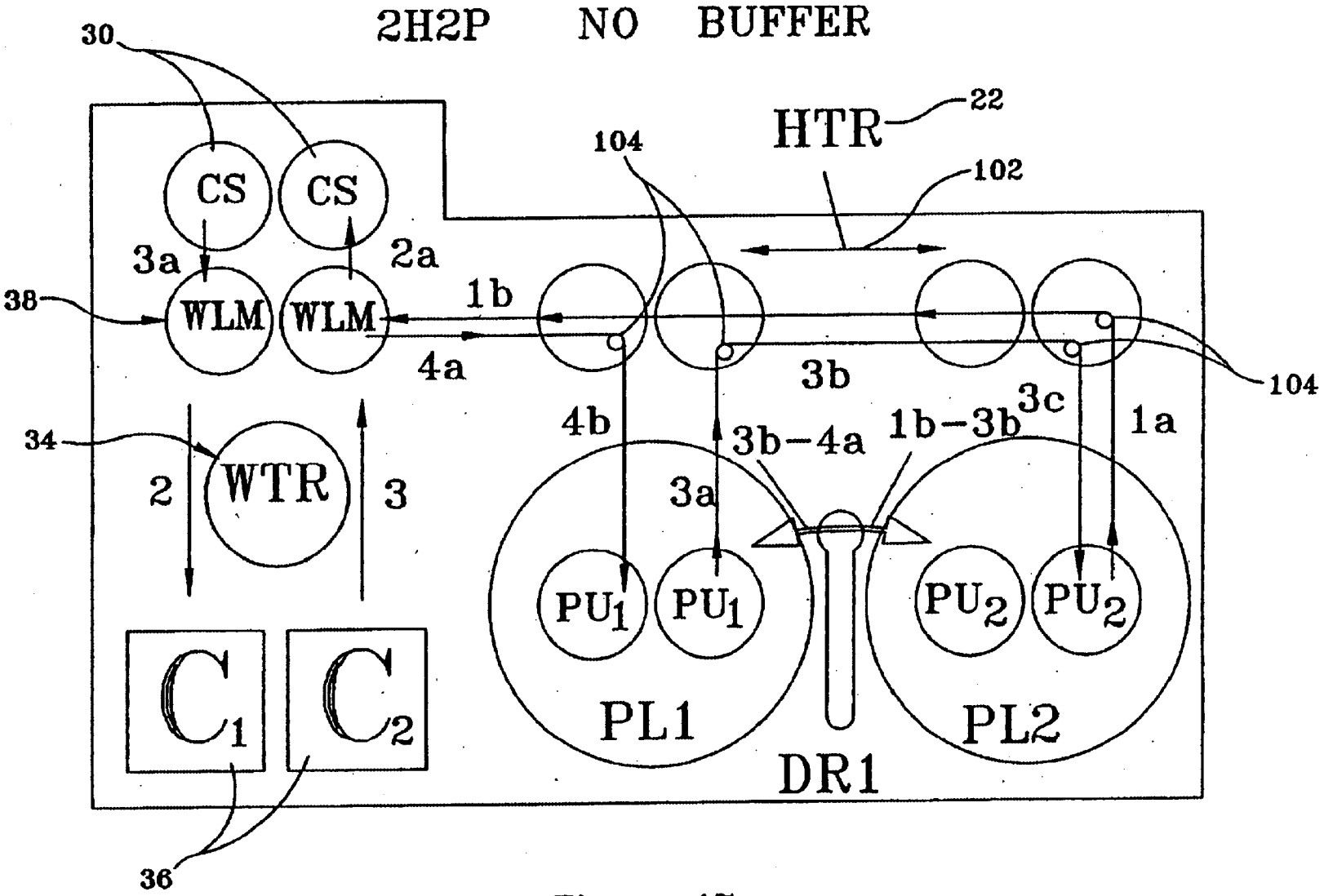
FIG. 17 is a diagram in plan view showing the processing steps of a machine of the present invention in linear (Cartesian) configuration of the machine with two platens and two set of heads.
Figure 18:
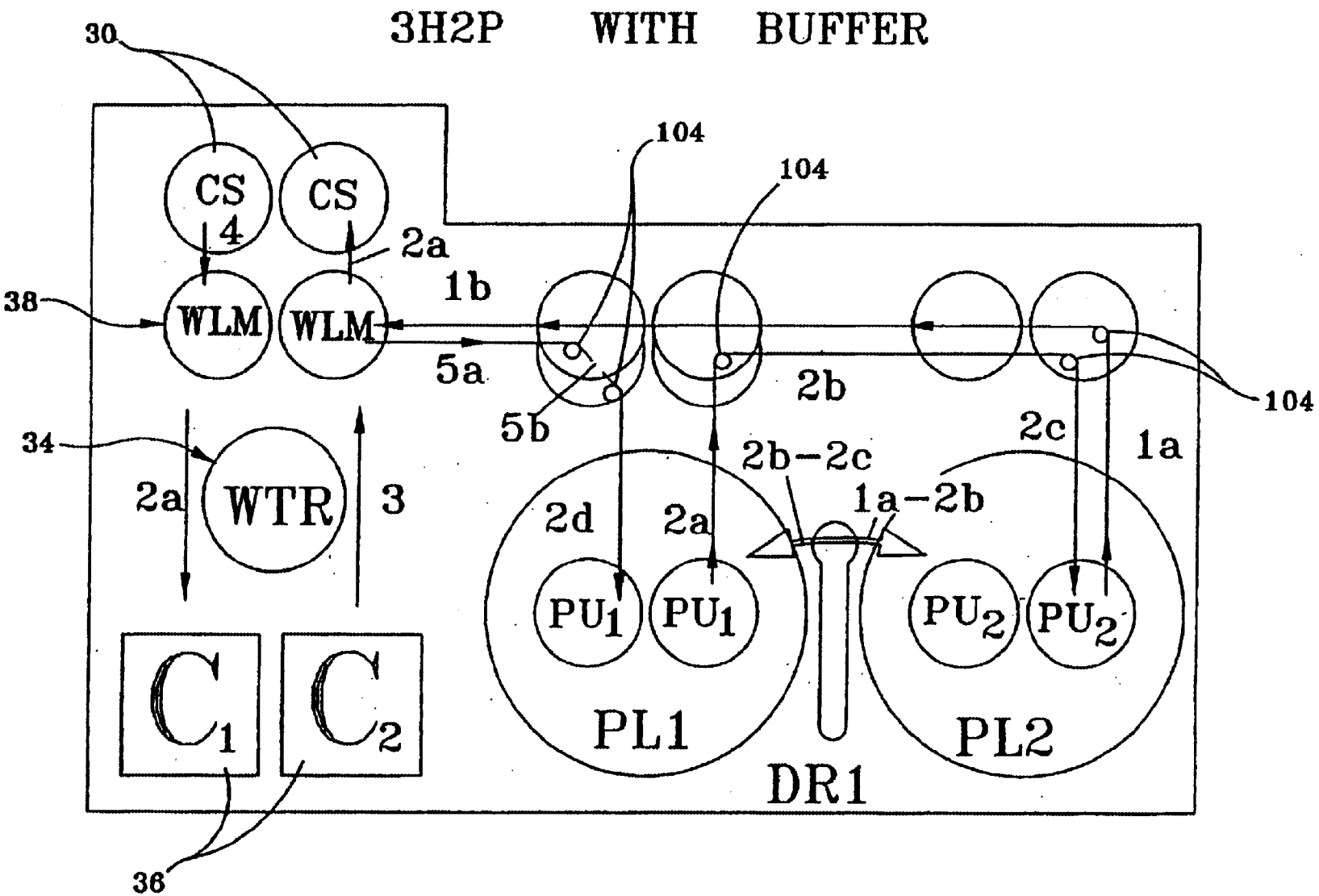
FIG. 18 is a diagram in plan view showing the processing steps of a machine of the present invention with two platens and three set of heads.

With respect to FIG. 16, there is shown a diagram in plan view showing the processing steps of a machine of the present invention in radial (polar) configuration of the machine with two platens and two sets of heads. Similarly, FIG. 17 is a diagram in plan view showing the processing steps of a machine of the present invention in linear (Cartesian) configuration of the machine with two platens and two sets of head, yet no buffer. Also there is shown in FIG. 18, a diagram in plan view showing the processing steps of the machine with two platens, three sets of heads and a buffer.

Figure 19:
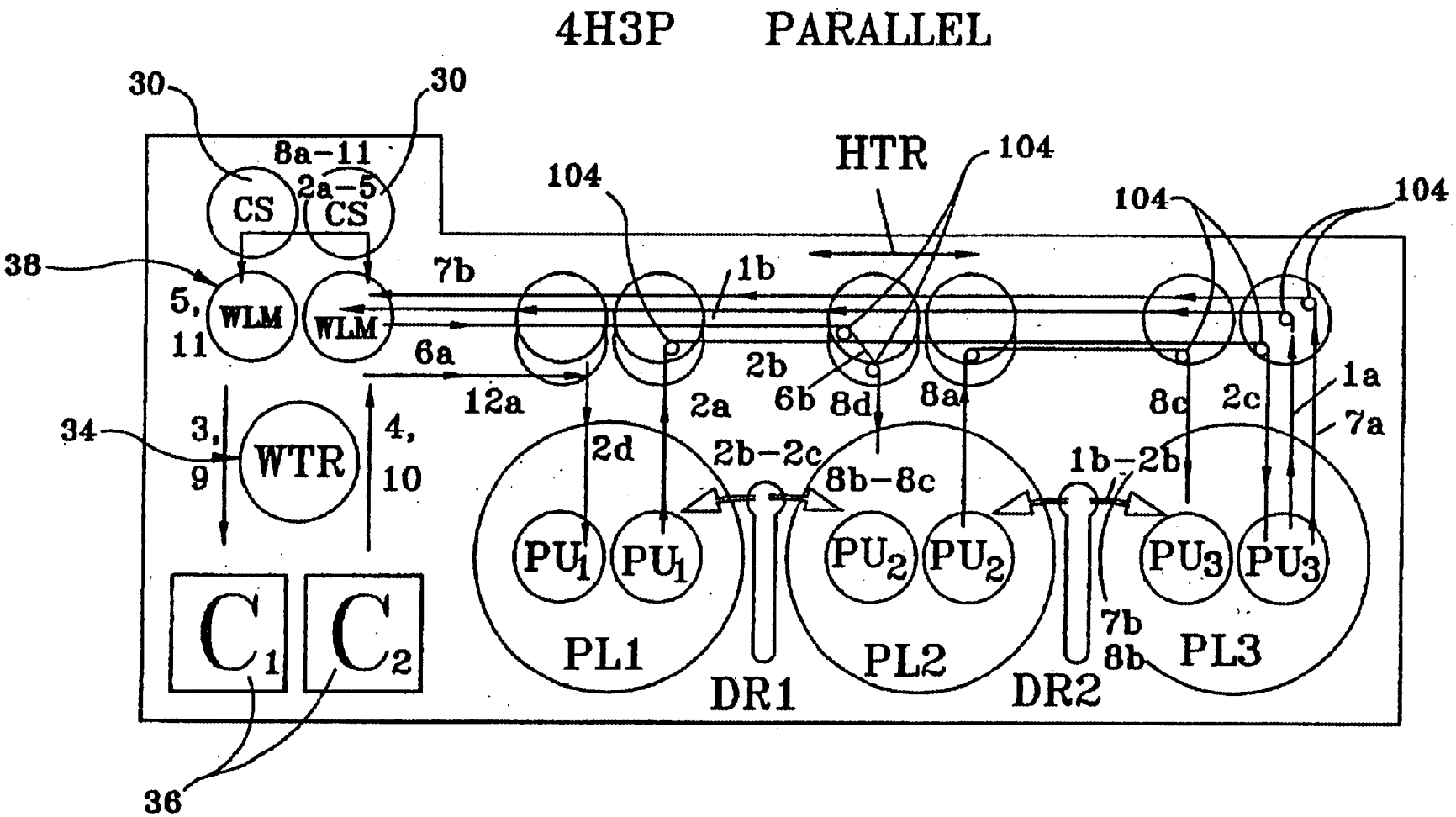
FIG. 19 is a diagram in plan view showing the processing steps of a machine of the present invention with three platens and four set of heads for parallel processing.

With respect to FIG. 19, there is shown a machine of the present invention having four pairs of heads 20, three platens, PL1, PL2, and PL3, and parallel paths labeled with alphanumerics, whereby parallel processing cycles occur progressively as indicated by said paths.

Figure 20:
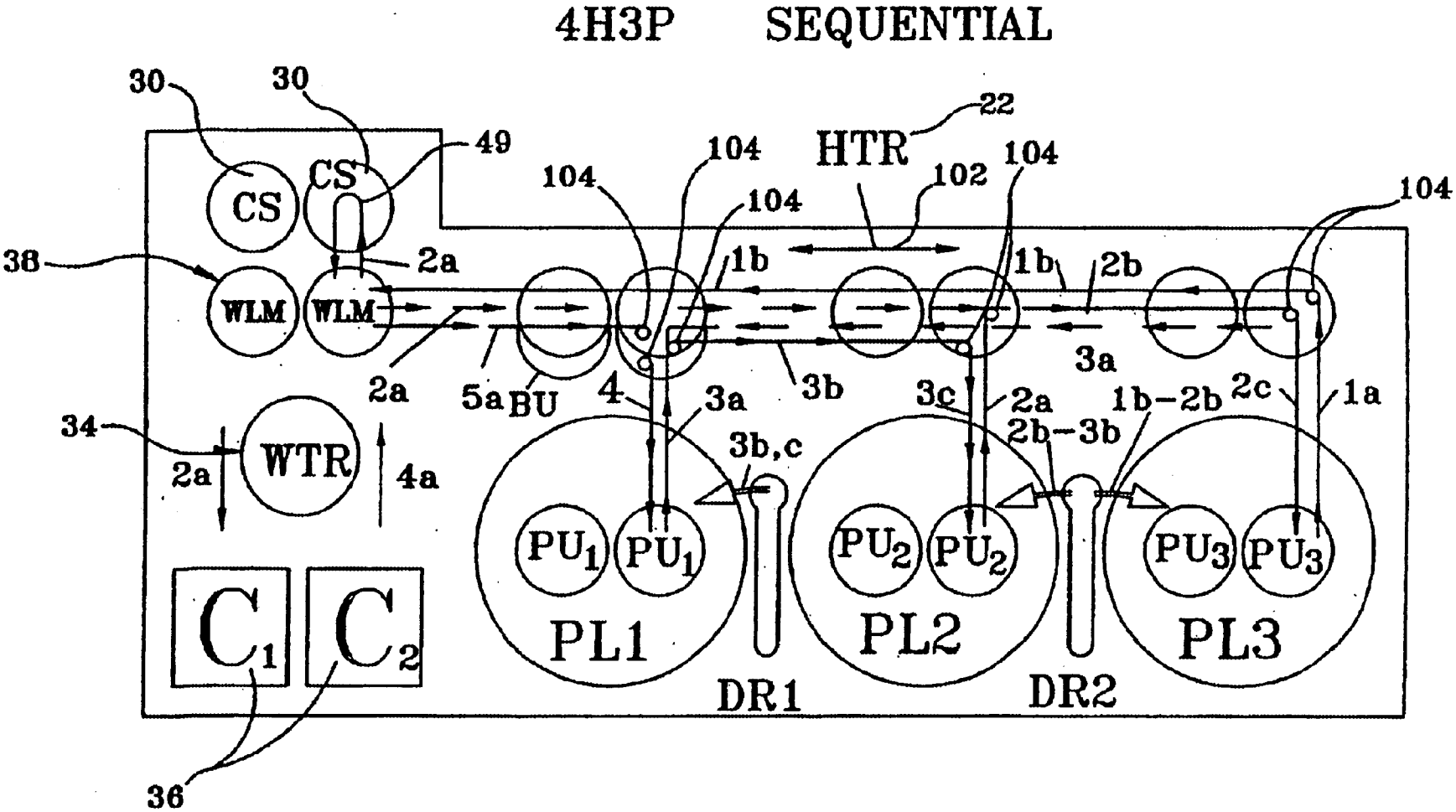
FIG. 20 is a diagram in plan view showing the processing steps of a machine of the present invention with three platens and four set of heads for sequential processing (three step polishing).

With respect to FIG. 20, there is shown a machine of the present invention having four pairs of heads 20 and three platens, PL1, PL2 and PL3 and sequential paths. As depicted by 1*a*–1*b*, after final polishing, the heads with wafers on PU3 are transferred to WLM 38, and dressing begins on PL3. At 2*a*, the empty HTR 22 moves to participate in progression along path 2*a*–2*c* and includes transfers of heads from mid-grade polishing on PL2 to final polishing on PL3; 1*b*–2*b* indicates dressing of PL2: at 2*a* wafers are dropped to WLM 38 and heads proceed to cleaning station 30. At 3*a*, the empty HTR 22 moves to participate in progression along path 3*a*–3*c*, where the heads with wafers are transferred from stock polishing on PL1 to PL2. At 3*b*, dressing begins on PL1; At 4*a*, heads move from B1 in an upper position to PL1 for stock polishing; also at 4*a* empty heads go from cleaning station 30 to WLM 38. In 5*a*, unpolished wafers are transferred from WLM to B1 (back to starting position). From times 2*a* to 4*a*, WTR is replacing wafers to and from cassette platforms 36.

Alternatively, a method for polishing wafers with a system having a machine base is provided whereby a frame mechanically associated with the machine base; at least one platen, at least one polishing unit, at least two independent heads, each polishing unit of the at least one polishing unit having means for coupling/decoupling at least one independent head of the independent heads; means for horizontal transfer of the at least one polishing unit; at least one buffer and at least one HTR; the method comprising the steps of: loading a first wafer into the first head of the at least two heads; shuttling the first loaded head of the at least two heads to the at least one buffer; translating a first polishing unit of the at least one polishing unit to the first loaded head of the at least two heads; coupling the first loaded head to the first polishing unit; translating the first polishing unit of the at least one polishing unit with the first loaded head of the at least two heads to the at least one platen; performing a polishing operation with the first polishing unit of the at least one polishing unit; contemporaneously with one or more of the previous steps, performing one or more of the following steps: loading a second wafer into a second head of the at least two heads; shuttling the second loaded head of the at least two heads to the at least one buffer; translating a second polishing unit of the at least one polishing unit to the second loaded head of the at least two heads; coupling the second loaded head of the at least two heads to the second polishing unit of the at least one polishing unit; translating the second polishing unit of the at least one polishing unit with the second loaded head of the at least two heads to the at least one platen; and starting a second polishing operation with the second polishing unit; and completing the first polishing process; and translating the first polishing unit of the at least one polishing unit to the buffer; decoupling the first loaded head of the at least two heads from the first polishing unit of the at least one polishing unit; and shuttling the first loaded head of the at least two heads to a predetermined location.

Although the foregoing examples are merely illustrative of a few of the many possible configuration and/or multi-processing schemes, it can be seen that that unique combination of independent, movable heads and the HTR arrangement provide both maximized throughput and wafer protection.

INDUSTRIAL APPLICABILITY

The present invention provides an apparatus and method for polishing work pieces such as semiconductor wafers. The apparatus includes a variable number of independent heads, platens and polishing units. This polishing apparatus belongs to a group of polishing machines with wafers attached to the same heads through all polishing steps without undesirable reloading from one head to another between polishing steps. Each independent head is automatically coupled to and decoupled from any of the polishing units to optimize throughput and provide flexibility in accommodating different polishing processes. A head transfer subsystem provides an independent means of transfer for each head, thus an infinite number of contemporaneous or overlapping polishing cycles can be completed on multiple wafers resulting in maximum processing throughput. In light of the foregoing, it is contemplated that the present invention will prove highly marketable to consumers in various venues, particularly those seeking the technical functionality and features provided in the invention.

SCOPE OF THE INVENTION

Although the description above contains much specificity, these should not be construed as limiting the scope of the invention but as merely providing illustrations of some of the presently preferred embodiments of this invention. Thus the scope of this invention should be determined by the appended claims and their legal equivalents. Therefore, it will be appreciated that the scope of the present invention encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more". All structural, chemical, and functional equivalents to the elements of the above-described preferred embodiment that are know to those of ordinary skill in the art are expressly incorporated herein by reference and are intended to be encompassed by the present claims. Moreover, it is not necessary for a device or method to address each and every problem sought to be solved by the present invention for it to be encompassed by the present claims. Furthermore, no element, component, or method step in the present disclosure is intended to be dedicated to the public regardless of whether the element, component, or method step is explicitly recited in the claim. No claim element herein is to be construed under the provisions of 35 U.S.C. 112, sixth paragraph, unless the element is expressly recited using the phrase "means for".

What is claimed is:

1. A system for polishing at least one wafer, the system comprising:

a machine base;

a frame associated with the machine base;

at least one platen mechanically associated with the machine base;

at least one polishing unit associated with the frame, the polishing unit having means for accommodating at least one polishing head;

at least two independent heads for accommodation of the at least one wafer per head;

means for coupling/decoupling mechanically associated with the at least one polishing unit wherein at least one of the at least two independent heads can be interchangeably, temporarily and removably coupled to the polishing unit for a duration of at least one process step but less than one process cycle;

means for connect/disconnect controlling said means for coupling/decoupling; and at least one head transfer mechanism associated with the frame for transfer of heads decoupled from the at least one polishing unit;

whereby the means for coupling/decoupling automatically couple and decouple at least one head of the at least two heads to and from the at least one polishing unit and the at least one decoupled head is transferred between the at least one polishing unit and a second location.

2. The system of claim 1, further comprising at least one buffer for temporary accommodation of at least one head of the at least two independent heads, the at least one buffer mechanically associated with the machine base and generally forming a head holder.

3. The system of claim 2, wherein the buffer has means for providing the buffer with vertical travel.

4. The system of claim 1, further comprising at least one WLM for temporary accommodation of the at least one wafer, the at least one WLM mechanically associated with the machine base.

5. The system of claim 1, further comprising a head holder wherein the said head holder is located above WLM.

6. The system of claim 1, further comprising at least one WTR associated with the WLM and at least one wafer cassette, the WTR transferring wafers between the at least one wafer cassette and the WLM.

7. The system of claim 1, wherein the means for coupling/decoupling further comprises means for rotational alignment.

8. The system of claim 1, further comprising at least one pad dresser associated with the at least one platen.

9. The system of claim 1, further comprising means for horizontal transfer associated with the at least one polishing unit.

10. The system of claim 1, wherein the at least one head transfer mechanism further comprises at least one member selected from a group essentially consisting of means for holding the at least one head and means for repositioning the at least one head.

11. The system of claim 10, wherein the means for holding further comprises a pair of arms.

12. The system of claim 1, further comprising a cleaning station associated with the machine base for cleaning the at least one head.

13. The system of claim 11, wherein the cleaning station further comprises at least one member of the group consisting essentially of: a brush, a water nozzle and means for rotation.

14. The system of claim 1, wherein the means for coupling/decoupling further comprises at least one member selected from the group consisting essentially of means for connect/disconnect and means for rotational alignment.

15. The system of claim 1, wherein the means for connect/disconnect further comprise at least one member of a group consisting essentially of vacuum means, a non-vacuum means, latching means and ball means.

16. The system of claim 14, wherein the means for alignment further comprises a pin.

17. The system of claim 1, further comprising at least one member of the group consisting of:

means for horizontal transfer associated with the at least one polishing unit;

at least one buffer associated with the at least one head;

at least one HTR having means for head holding;

at least one cassette platform associated with the machine base;

a WTR associated with the at least one cassette platform;

a WLM associated with the WTR; and a cleaning station.

18. A system for polishing at least one wafer, the system comprising:

a machine base;

a frame associated with the machine base;

at least one platen mechanically associated with the machine base;

at least one polishing unit associated with the frame, the polishing unit having means for accommodating at least one polishing head;

means for horizontal transfer associated with the at least one polishing unit;

at least two independent heads for accommodation of the at least one wafer per head;

means for coupling/decoupling mechanically associated with the at least one polishing unit wherein at least one of the at least two independent heads can be interchangeably, temporarily and removably coupled to the means for coupling/decoupling for a duration of at least one process step but less than one process cycle;

means for connect/disconnect controlling the means for coupling/decoupling;

at least one buffer associated with the at least one head;

at least one HTR having means for head holding, the at least one HTR mechanically associated with the frame;

at least one cassette platform associated with the machine base;

a WTR associated with the at least one cassette platform;

a WLM associated with the WTR; and a head cleaning station;

whereby the means for coupling/decoupling automatically couple and decouple at least one head of the at least two heads to and from the at least one polishing unit and the at least one decoupled head is transferred between the at least one polishing unit, the at least one buffer and a third location.

19. A method for polishing workpieces on polishing machine having at least one rotatable platen, at least one polishing unit, at least two independent heads for accommodation of one wafer per head; means for coupling/decoupling associated with at least one polishing unit, wherein at least one of the at least two independent heads can be interchangeably, temporarily and removably coupled to the at least one polishing unit for a duration of at least one process step but less than one process cycle; whereby said method comprises the steps of:

circulating all said heads inside of the machine; and carrying out, in sequence or simultaneously, at least two operations selected from a group consisting essentially of polishing, replacing independent heads on a polishing unit, transferring heads and replacing wafers on independent heads.

20. The method of claim 19, wherein the group further comprises buffering.

21. A method for polishing a set of wafers with a system having a machine base, a frame mechanically associated with the machine base; at least one platen, at least one polishing unit, at least two polishing heads, each said polishing unit having means for coupling/decoupling with said heads and having means for horizontal transfer of the polishing unit; at least one buffer and at least one HTR; the method comprising essentially the steps of:

polishing a first subset of the set of wafers, whereby the first subset of the set of wafers is contained in the first of the at least two polishing heads;

replacing the first of the at least two polishing heads having the first subset of the set of wafers from the first of at least one polishing unit with a second of the at least two heads having a second subset of the set of wafers;

contemporaneously polishing the second subset of the set of wafers and shuttling the first of at least two heads to a position whereby the first subset of the set of wafers is replaced with a new subset of the wafers to be polished.

22. The method of claim 21, further comprising the steps of interchangeably replacing the independent heads on a first polishing unit, transferring the independent heads from the one polishing unit to a next polishing unit and polishing at least one wafer associated with the independent heads.

23. The method according to claim 21 further comprising the additional step of cleaning the independent heads.

24. A method for polishing wafers with a system having a machine base, a frame mechanically associated with the machine base; at least one platen, at least one polishing unit, at least two independent heads, each polishing unit of the at least one polishing unit having means for coupling/decoupling at least one independent head of the independent heads; means for horizontal transfer of the at least one polishing unit; at least one buffer and at least one HTR; the method comprising the steps of:

loading a first wafer into the first head of the at least two heads;

shuttling the first loaded head of the at least two heads to the at least one buffer;

translating a first polishing unit of the at least one polishing unit to the first loaded head of the at least two heads;

coupling the first loaded head to the first polishing unit;

translating the first polishing unit of the at least one polishing unit with the first loaded head of the at least two heads to the at least one platen;

performing a polishing operation with the first polishing unit of the at least one polishing unit;

contemporaneously with one or more of the previous steps, performing one or more of the following steps:

loading a second wafer into a second head of the at least two heads;

shuttling the second loaded head of the at least two heads to the at least one buffer;

translating a second polishing unit of the at least one polishing unit to the second loaded head of the at least two heads;

coupling the second loaded head of the at least two heads to the second polishing unit of the at least one polishing unit;

translating the second polishing unit of the at least one polishing unit with the second loaded head of the at least two heads to the at least one platen;

starting a second polishing operation with the second polishing unit; and completing the first polishing process;

translating the first polishing unit of the at least one polishing unit to the buffer;

decoupling the first loaded head of the at least two heads from the first polishing unit of the at least one polishing unit; and shuttling the first loaded head of the at least two heads to a predetermined location.

* * * * *

UNITED STATES PATENT AND TRADEMARK OFFICE

CERTIFICATE OF CORRECTION

PATENT NO. : 6,875,076 B2
DATED : April 5, 2005
INVENTOR(S) : Abrahamians et al.

It is certified that error appears in the above-identified patent and that said Letters Patent is hereby corrected as shown below:

Column 1,
Line 7, “Wafer” should be -- “Wafer --.

Column 3,
Line 47, “ranges” should be -- range --.

Column 4,
Line 11, after “accommodation” insert -- of --.

Column 5,
Line 33, “CARRY” should be -- CARRYING --.

Column 6,
Line 62, “an” should be -- and --.

Column 7,
Line 64, after “such” insert -- as --.

Column 11,
Line 51, “PL1;” should be -- PL1. --.

Column 12,
Line 28, delete 2nd occurrence of “that” and replace with -- the --.

Column 13,
Line 4, “know” should be -- known --.

Signed and Sealed this

Fourth Day of October, 2005

JON W. DUDAS
*Director of the United States Patent and Trademark Office*